United States Patent [19]

Tamehiro et al.

[11] Patent Number: 4,990,196

[45] Date of Patent: Feb. 5, 1991

[54] PROCESS FOR MANUFACTURING BUILDING CONSTRUCTION STEEL HAVING EXCELLENT FIRE RESISTANCE AND LOW YIELD RATIO

[75] Inventors: Hiroshi Tamehiro; Rikio Chiziiwa, both of Kimitsu; Yoshifumi Sakumoto, Tokyo; Kazuo Funato; Yuzuru Yoshida, both of Kimitsu; Koichiro Keira, Tokyo, all of Japan

[73] Assignee: Nippon Steel Corporation, Tokyo, Japan

[21] Appl. No.: 364,608

[22] Filed: Jun. 9, 1989

[30] Foreign Application Priority Data

| | | | |
|---|---|---|---|
| Jun. 13, 1988 | [JP] | Japan | 63-143740 |
| Aug. 5, 1988 | [JP] | Japan | 63-195600 |
| Jun. 2, 1989 | [JP] | Japan | 1-139328 |
| Jun. 2, 1989 | [JP] | Japan | 1-139329 |

[51] Int. Cl.[5] ..... C21D 8/00

[52] U.S. Cl. ..... 148/12.4; 148/12 F; 148/12.1

[58] Field of Search ..... 148/12 F, 12 R, 12.4, 148/12.1

[56] References Cited

FOREIGN PATENT DOCUMENTS

| | | | |
|---|---|---|---|
| 1182721 | 2/1985 | Canada | 148/12 F |
| 5228425 | 3/1977 | Japan | 148/12 F |
| 5528336 | 2/1980 | Japan | 148/12 F |
| 58210125 | 12/1983 | Japan | 148/12 F |

*Primary Examiner*—Deborah Yee

*Attorney, Agent, or Firm*—Kenyon & Kenyon

[57] ABSTRACT

Disclosed is a process for manufacturing a building construction steel having excellent high-temperature characteristics, which can be marketed at an economically reasonable price. According to this process, a slab having a steel composition in which appropriate amounts of Mo and Nb are added to a low-C and low-Mn steel is heated at a high temperature and rolling is finished at a relatively high temperature, or a slab having a steel composition in which an appropriate amount of Mo is added to a low-C and low-Mn steel composition is heated at a high temperature, rolling is finished at a relatively high temperature, and at the subsequent air-cooling step, water cooling is started at a temperature of a ferrite fraction of 20 to 50% during the transformation from austenite to ferrite, water cooling is carried out to an arbitrary temperature lower than 550° C., followed by air cooling.

12 Claims, 14 Drawing Sheets

Yp: YIELD POINT

Ts: TENSILE STRENGTH

Yp: YIELD POINT

Ts: TENSILE STRENGTH

DEFORMATION QUANTITY
( COATING THICKNESS : 10 mm )

Fig. 8 (a)
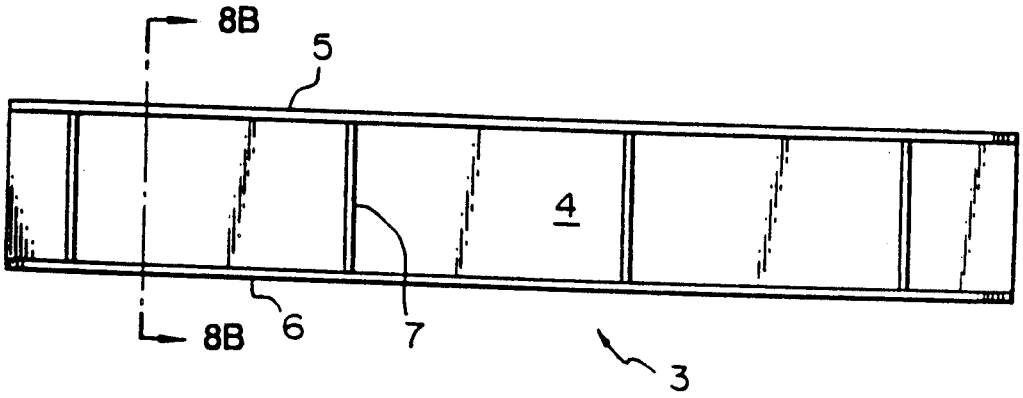
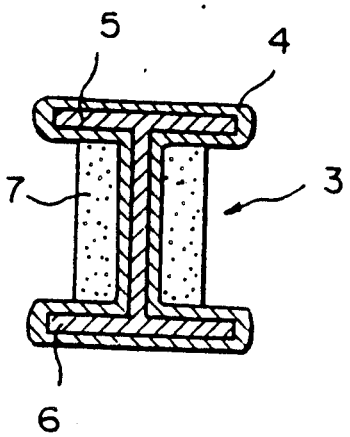
Fig. 8 (b)

UNCOATED STEEL FRAME (EMISSIVITY = 0.7)

UNCOATED STEEL FRAME (EMISSIVITY = 0.4)

PROCESS FOR MANUFACTURING BUILDING CONSTRUCTION STEEL HAVING EXCELLENT FIRE RESISTANCE AND LOW YIELD RATIO

BACKGROUND OF THE INVENTION

1. Field of the Invention

The present invention relates to a process for manufacturing steel having an excellent fire resistance and a low yield ratio, which is used for various buildings in the fields of architecture, civil engineering, offshore structures and the like, and a building construction steel material composed of this steel.

2. Description of the Related Art

As is well known, a rolled steel for general structural use (JIS G-3101), a rolled steel for welded structure (JIS G-3106), a weather-resistant hot-rolled steel for welded structure (JIS G-3114), a highly weather-resistant rolled steel (JIS G-3125), a carbon steel pipe for general structure (JIS G-3444), and a rectangular steel pipe for ordinary construction (JIS G-3466) are widely used as construction materials for buildings in the fields of architecture, civil engineering, offshore structures and the like.

In general, these steels are produced by removing S and P from pig iron obtained in a blast furnace, carrying out refining in a converter, forming a slab, billet or bloom (hereinafter the description refers to a slab) by continuous casting or blooming, and subjecting the slab to a hot rolling processing to obtain a product having desired properties.

When a steel as mentioned above is used for building having a close relationship to everyday life, e.g., offices and houses, to maintain the fire safety thereof, it is legally stipulated that a fire-proof coating must be formed on the steel material, and according to the regulations concerning building, it is prescribed that the steel temperature must not exceed 350° C. during a fire. Namely, the yield strength of a steel as mentioned above at a temperature of about 350° C. is reduced to 60 to 70% of the yield strength at normal temperature, and thus there is a risk of a collapse of the building, and therefore, a loss of the load bearing capacity of the steel by thermal damage during a fire must be prevented. For example, in the case of a building comprising, as the column material, a section steel stipulated by JIS G-3101 (rolled steel for general structural used), a fire-proof coating must be carefully formed by spreading a spray material comprising slag wool, rock wool, glass wool or asbestos as the base or a felt material on the steel surface or covering the steel surface with fire-proofing mortar, or further protecting the formed heat-insulating layer with a metal thin sheet such as an aluminum or stainless steel thin sheet.

Accordingly, the cost of forming the fire-proofing coating becomes high, compared with the cost of the steel, and thus a drastic increase of the construction costs cannot be avoided.

Therefore, a technique has been proposed of preventing an elevation of the temperature during a fire, without a reduction of the load bearing capacity, by adopting a structure in which cooling water is circulated through a round or square tube used as the construction material, and by using this technique, to reduce the construction costs of a building and expand the utilizable space. For example, Japanese Examined Utility Model Publication No. 52-16021 discloses a fire-proofing building which comprises a water tank installed in the upper portion of the building and columns composed of hollow steel tubes into which cooling water is supplied from the water tank.

Also, Japanese Unexamined Patent Publication No. 63-190117 discloses a process for producing a building construction material by a direct hardening process, but this process is not suitable because a normal temperature strength of a building material is too high.

A building material produced by a process disclosed by Japanese Unexamined Patent Publication No. 63-145717 can not obtain a high temperature strength for reason of a temperature to heat a slab is low, therefore a ratio of a normal temperature yield strength to a high temperature yield strength is low.

In a Cr-Mo steel disclosed by Japanese Unexamined Patent Publication No. 55-41960, the good characteristics of welding for a building material can not be maintained, because Cr is too high.

Where the conventional steel is utilized for the above-mentioned building, the cost of the steel is low, but because the high temperature strength is unsatisfactory, the steel cannot be utilized in the uncoated or lightly coated condition, and an expensive fire-resistant coating must be applied. Accordingly, the construction cost is increased and the utilizable space of the building reduced, and a problem of a reduction of the cost-performance arises. The method of supplying forced cooling by using hollow steel tubes is defective in that, since the structure is complicated, not only the equipment cost but also the maintenance and operating costs are increased.

Furthermore, since the known heat-resistant steel material represented by stainless steel is very expensive, although the high-temperature strength is excellent, from the viewpoint of the manufacturing technique and from the economical viewpoint, it is not practical to use the known heat-resistant steel as a construction material.

Recently, it has become possible to increase the number of stories in a building due to an increased reliability of design techniques, and therefore, the subject of fire-proof designs has been reconsidered. In 1987, a new law for a fire proof design for buildings was established, whereby it became permissible to determine the capacity of a fire resistance of a building material in accordance with a high-temperature strength and a load practically applied to a building, without the restriction of the above-mentioned temperature limitation of 350° C. In some cases, it is possible to use a steel material in the uncoated condition.

Currently, however, a construction steel material having an excellent fire resistance and able to be marketed at a reasonable price is not known.

SUMMARY OF THE INVENTION

The present invention is intended to solve the foregoing problems of the conventional techniques. Therefore, a primary object of the present invention is to provide a fire-resistant steel which has excellent high-temperature characteristics and can be marketed at a reasonable price.

Another object of the present invention is to provide a construction steel having a low yield ratio such that the high temperature yield strength at about 600° C. is at least about ⅔ (70%) of the yield strength at normal temperature.

Still another object of the present invention is to provide a steel having an excellent fire resistance, in which the amounts of expensive alloying elements are reduced and which can be used in the uncoated condition as a high-temperature material.

A further object of the present invention is to provide a valuable fire-resistant construction material composed of a steel as described above.

Other objects and advantages of the present invention will become apparent from the following detailed description.

In accordance with one aspect of the present invention, the foregoing objects can be attained by a construction steel material having an excellent fire resistance and a low yield ratio, which is obtained by heating a slab comprising 0.04 to 0.15% by weight of C, up to 0.6% by weight of Si, 0.5 to 1.6% by weight of Mn, 0.005 to 0.04% by weight of Nb, 0.4 to 0.7% by weight of Mo, up to 0.1% by weight of Al and 0.001 to 0.006% by weight of N, and optionally at least one member selected from the group consisting of 0.005 to 0.10% by weight of Ti, 0.005 to 0.03% by weight of Zr, 0.005 to 0.10% by weight of V, 0.05 to 0.5% by weight of Ni, 0.05 to 1.0% by weight of Cu, 0.05 to 1.0% by weight of Cr, 0.0003 to 0.002% by weight of B, 0.0005 to 0.005% by weight of Ca and 0.001 to 0.02% by weight of REM, with the balance being Fe and unavoidable impurities, at a temperature of from 1100° to 1300° C. and finishing hot rolling at a temperature of from 800° to 1000° C.

In accordance with another aspect of the present invention, there is provided a process for producing a construction steel having an excellent fire resistance and a low yield ratio, which comprises heating a slab comprising 0.04 to 0.15% by weight of C, up to 0.6% by weight of Si, 0.5 to 1.6% by weight of Mn, 0.2 to 0.7% by weight of Mo, up to 0.1% by weight of Al and up to 0.006% by weight of N, and optionally at least one member selected from the group consisting of 0.005 to 0.04% by weight of Nb, 0.005 to 0.10% by weight of Ti, 0.005 to 0.03% by weight of Zr, 0.005 to 0.10% by weight of V, 0.05 to 0.5% by weight of Ni, 0.05 to 1.0% by weight of Cu, 0.05 to 1.0% by weight of Cr, 0.0003 to 0.002% by weight of B, 0.0005 to 0.005 by weight of Ca and 0.001 to 0.02% by weight of REM, with the balance being Fe and unavoidable impurities at a temperature in the range of 1100° to 1300° C., finishing hot rolling at a temperature of from 800° to 1000° C., air-cooling the rolled steel to a temperature of from $Ar_3$-20° C. to $Ar_3$-100° C., water cooling the steel from said temperature to an optional temperature lower than 550° C. at a cooling rate of 3° to 40° C./sec, and then allowing the steel to cool naturally.

Furthermore, according to the present invention, there is provided a construction steel material having an excellent fire resistance and a low yield ratio, which comprises a fire-proofing material such as an inorganic fibrous fire-proofing thin-layer material, a highly heat-resistant paint layer or a heat-insulating shield plate, which is attached to a steel obtained according to the above-mentioned producing process.

Still further, according to the present invention, there is provided a construction steel material (a build up steel material), which is made by forming a steel obtained according to the above-mentioned producing process and an conventional structural steel into predetermined shapes, and welding them.

BRIEF DESCRIPTION OF THE DRAWINGS

FIG. 8-A is a schematic elevation of a beam formed by spreading a rockwool on an H-shape of the present invention by spraying (wet type) and FIG. B is a view showing the section taken along the line A-A in FIG. 8-A;

DESCRIPTION OF THE PREFERRED EMBODIMENTS

Figure 1:
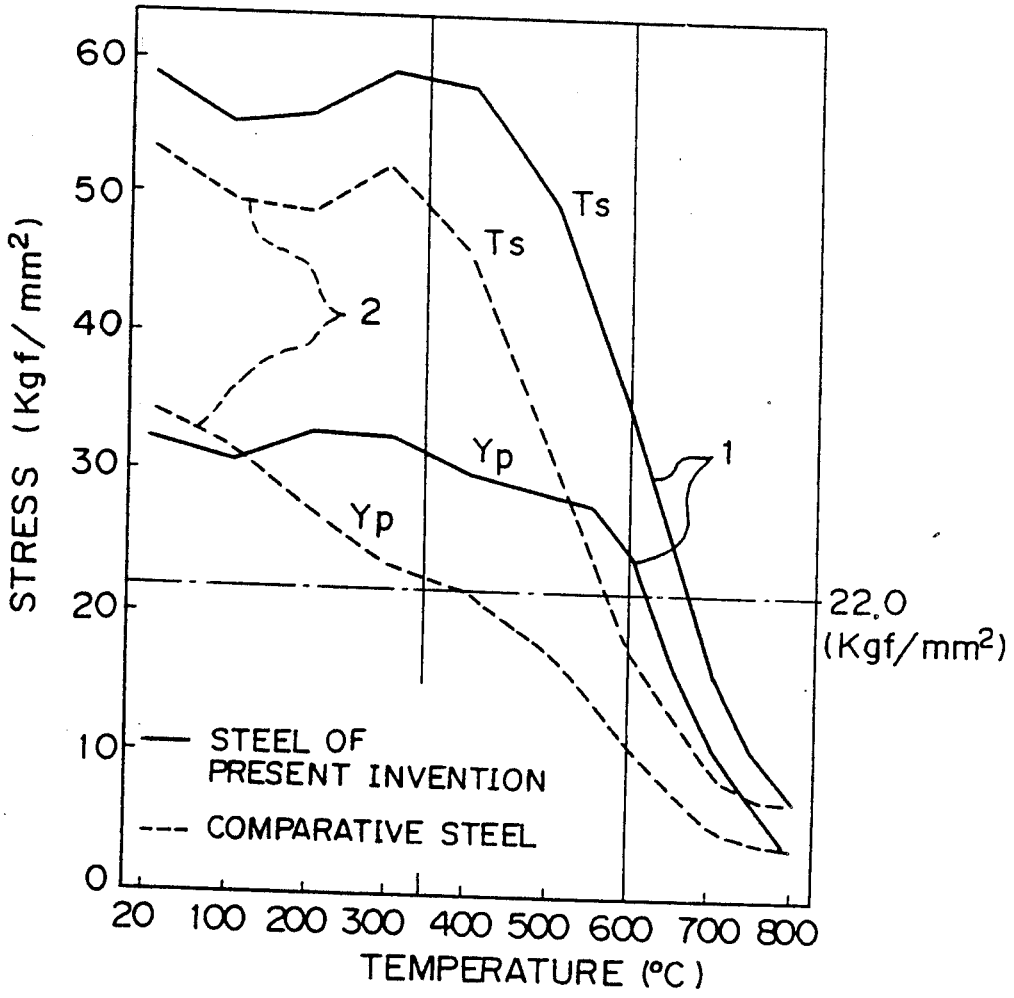
FIG. 1 is a graph comparing the steel of the present invention with a comparative steel with respect to the yield strength and tensile strength at a high temperature.

As the result of research made by the present inventors into the steel strength during a fire it was found that, when the use of an uncoated steel material is intended, since a highest temperature during a fire is about 1000° C., large amounts of expensive alloying elements must be incorporated to retain at this temperature a yield strength of at least $\frac{2}{3}$ of the yield strength at normal temperature, and this is economically disadvantageous.

Namely, the price of this uncoated steel material exceeds the sum of the cost of a conventional steel and the cost of a fire-resistant coating formed thereon, and thus the uncoated steel cannot be practically utilized.

After further research, it was found that a steel retaining at 600° C. a yield strength of at least $\frac{2}{3}$ of the yield strength at normal temperature is most advantageous from the economical viewpoint. Based on this finding, a process was completed for manufacturing a steel in which the amounts of expensive alloying elements are reduced and a reduction of the thickness of a fire-resistant coating is possible, and which can be used in the uncoated condition when the fire load is small, and a steel material formed by imparting particular fire-proofing performances to the steel manufactured by this process.

A characteristic feature of the present invention is that a slab having a composition formed by adding a minute amount of Nb and an appropriate amount of Mo to a low-C and low-Mn steel composition is heated at a high temperature and rolling is finished at a relatively high temperature. The steel obtained according to this process is characterized in that it has an appropriate yield strength at normal temperature and a high yield strength at a high temperature.

Namely, the ratio of the yield strength at a temperature of 600° C. to the yield strength at normal temperature is large. This is because the number of basic components other than Nb and Mo is small and the microstructure is composed mainly of relatively large ferrite.

The steel material obtained according to the present invention has a low yield ratio and an excellent earthquake resistance. This is because the microstructure is composed of relatively large ferrite.

The amounts of characteristic alloying elements in the preparation process will now be described.

Nb and Mo form fine carbonitrides, and further, Mo has the solid solution hardening, whereby the high-temperature strength is increased. But if Mo alone is added, a satisfactory yield strength cannot be obtained at a high temperature of 600° C.

As the result of research by the present inventors, it was found that a combined addition of Nb and Mo is especially effective for increasing the yield strength at the above-mentioned high temperature.

But, if the amounts of Nb and Mo are too large, the weldability is degraded and the toughness of the weld heat-affected zone is also deteriorated, and accordingly, the upper limits of the Nb and Mo contents must be set at 0.04% and 0.7%, respectively. The lower limits of the Nb and Mo contents are set at minimum levels capable of obtaining the intended effects by the combined addition, i.e., 0.005% and 0.4%, respectively.

In conventional heat-resistant steels, it is known that Mo is utilized for increasing the high-temperature strength, but in a fire-resistant steel used for building construction, it has not been known that a minute amount of Mo is added in combination with a minute amount of Nb.

An acicular ferrite steel is known as a steel in which Nb and Mo are added in combination. In the production of this acicular ferrite steel, to obtain the high strength and low temperature toughness, a controlled rolling is carried out whereby the yield strength at normal temperature is increased. Accordingly, the ratio of the yield strength at 600° C. to the field strength at a normal temperature is low, and thus the requirements for construction steel are not satisfied and the steel cannot be used for construction.

Moreover, in the acicular steel, the Mn content is higher than in the steel of the present invention and the Mo content is lower than that of the present invention. This is because the object of the acicular steel is different from that of the present steel, i.e., is to improve the low temperature toughness, and accordingly, both steels have very different objects and functional effects.

The reasons for limitation of the contents of elements other than Nb and Mo will now be described in detail.

C is necessary for maintaining the strength of the base material and welded zone and exerting the effects obtained by an addition of Nb and Mo, and the lower limit of the carbon content is set at 0.04% because the desired effects cannot be obtained if the C content is lower than 0.04%. If the C content is too high, the low-temperature toughness of the weld heat-affected zone (hereinafter referred to as "HAZ") is adversely influenced and the toughness and weldability of the base material are degraded. Accordingly, the upper limit of the C content is set at 0.15%.

Si is included in the steel as an deoxidizing element. If the Si content is increased, the weldability and HAZ toughness are degraded. Therefore, the upper limit of the Si content is set at 0.6%. In the present invention, only the Al deoxidation is sufficient, but the Ti deoxidation also can be performed. In view of the HAZ toughness, preferably the Si content is lower than about 0.15%.

Mn is an element indispensable for obtaining a good strength and toughness, and the lower limit of the Mn content is 0.5%. If the Mn content is too high, the hardenability is increased and the weldability and HAZ toughness are degraded, and the base material strength satisfying the target cannot be obtained. Therefore, the upper limit of the Mn content is set at 1.6%.

Al is an element generally contained in a deoxidized steel. In the present invention, since deoxidation can be performed by Si and/or Ti, the lower limit of Al is not specified, but if the Al content is increased, the cleanliness of the steel is degraded and the toughness of the welded zone is reduced. Accordingly, the upper limit of the Al content is set at 0.1%.

N is generally contained as an unavoidable impurity in steel, and N is combined with Nb to form a carbonitride Nb(CN) and improve the high-temperature strength. Accordingly, at least 0.001% of N is necessary. If the N content is too high, a deterioration in the HAZ toughness and a formation of surface defects in a continuously cast slab are promoted. Therefore, the upper limit of the N content is set at 0.006%.

In the steel material of the present invention, P and S are contained as unavoidable impurities, but since the influences of P and S on the high-temperature strength are small, the amounts of P and S are not particularly critical. Nevertheless, in general, the toughness and the strength in the through thickness direction are improved as the contents of these elements are decreased, and preferably the amounts of P and S denote exceed 0.02% and 0.005%, respectively.

The basic components of the steel of the present invention are as described above, and the intended objects can be obtained by these basic elements. If an element selected from Ti, Zr, V, Ni, Cu, Cr, B, Ca and REM is further added, the strength and toughness can be further improved.

The amounts of these elements will now be described.

Ti is an element exerting an effect substantially similar to the above-mentioned effect of Nb. Where the Al content is low, at a content of 0.005 to 0.02%, Ti forms an oxide and a carbonitride to improve the HAZ toughness. If the Ti content is lower than 0.005%, a substantial effect is not obtained, and if the Ti content exceeds 0.1%, the weldability becomes poor.

V exerts an effect similar to the effect of Nb or Ti. Although V is inferior to Nb or Ti in the effect of improving the high-temperature yield strength, V improves the strength at a content of 0.005 to 0.10%. At a V content lower than 0.005%, the desired effect is not obtained, and if the V content exceeds 0.10%, the HAZ toughness is lowered.

Ni improves the strength and toughness of the base material without lowering the weldability and HAZ toughness but if the Ni content is lower than 0.05%, the effect is low, and if Ni is added in an amount exceeding 0.5%, the steel becomes expensive as a construction steel and is economically disadvantageous. Accordingly, the upper limit of the Ni content is set at 0.5%.

Cu exerts an effect similar to the effect of Ni, and Cu is also effective for increasing the high-temperature strength by precipitates of Cu and improving the corrosion and weather resistance. But, if the Cu content exceeds 1.0%, Cu cracking occurs during the hot-rolling and the production becomes difficult. If the Cu content is lower than 0.05%, the desired effect is not obtained. Accordingly, the Cu content is limited to 0.05 to 1.0%.

Cr is an element increasing the strength of the base material and welded zone and is effective for improving the weather resistance. If the Cr content exceeds 1.0%, the weldability or HAZ toughness is lowered, and if the Cr content is low, the effect is low. Accordingly, the Cr content is limited to 0.05 to 1.0%.

It was found that Cr is an element increasing the high-temperature strength as well as Mo, but is different from Mo in that the effect of increasing the high-temperature strength at 600° C. is relatively low, compared with the effect of increasing the strength at normal temperature.

B is an element increasing the hardenability of the steel and improving the strength, and BN formed by combined with N acts as a ferrite-generating nucleus and makes the HAZ microstructure finer. To obtain these effects, B must be present in an amount of at least 0.0003%, and if the B content is lower than this value, the desired effect is not obtained. If the amount of B is too large, the coarse B constituent is precipitated in the austenitic grain boundary to lower the low-temperature toughness. Accordingly, the upper limit of the B content is set at 0.002%.

Ca and REM control the shape of the sulfide (MnS), increase the charpy absorbed energy, and improve the low-temperature toughness, and furthermore, Ca and REM improve the resistance to hydrogen-induced cracking. If the Ca content is lower than 0.0005%, a practical effect is not obtained, and if the Ca content exceeds 0.005%, CaO and CaS are formed in large quantities as large inclusions to lower the toughness and cleanliness of the steel, and the weldability becomes poor. The amount of C should be controlled to within the range of 0.0005 to 0.005%.

REM exerts effects similar to those of Ca. If the amount of REM is too large, the problems described above with respect to Ca arise, and thus the lower and upper limits of the REM amount are set at 0.001% and 0.02%, respectively.

The manufacturing process of the present invention will be further described.

To satisfy the requirement stipulated for a rolled steel for a welded structure (JIS G-3106) at normal temperature and maintain a high yield strength at the high temperature of 600° C., the conditions of heating and rolling the steel are as important as the composition of the steel. To increase the high-temperature yield strength by the combined addition of Nb and Mo, which constitutes one of the characteristic features of the present invention, it is necessary to dissolve these elements during heating, and for this purpose, the lower limit of the temperature of heating a slab having the steel composition of the present invention is set at 1100° C. If the heating temperature is too high, the resultant ferrite grain size becomes large and the low-temperature toughness is degraded. Accordingly, the upper limit of the heating temperature is set at 1300° C.

Then, the heated slab is hot-rolled, and the rolling is finished at a high temperature not lower than 800° C. This control is used to prevent a precipitation of Nb and Mo during the rolling. If these elements are precipitated in the $\gamma$-region, the size of the precipitates becomes large and the high-temperature yield strength is drastically lowered.

The known low-temperature rolling (controlled rolling) is indispensable for a steel for which a low-temperature toughness is necessary, for example, a line pipe, but where a good low-temperature toughness is not particularly required but the balance between the strength at normal temperature and the high-temperature strength at 600° C. is important, as in the steel of the present invention, the rolling must be finished at a high temperature. This condition is also important for reducing the yield ratio of normal temperature. In the present invention, to maintain the toughness necessary for a construction steel, the upper limit of the finish rolling temperature is set at 1000° C. After the completion of the hot rolling, the rolled sheet is naturally cooled to room temperature.

The so-produced steel can be re-heated at a temperature lower than the $Ac_1$ transformation temperature for dehydrogenation or the like, and the characteristics of the steel of the present invention are not lost by this re-heating.

In the present invention, a product is manufactured by heating the slab and then subjecting it to hot rolling in the above-mentioned manner. This product can be subjected to a hot or cold deforming process to obtain a desired steel material.

For example, a method can be adopted in which the steel is formed in a bloom or billet and is hot-deformed into a shape, and a method can be used in which the product is used as the material and cold-deformed into a desired steel material such as a shape or a pipe. In this case, a heat treatment can be carried out appropriately.

The properties of the steel material manufactured according to the present invention will now be described in comparison to those of the known materials.

Table 1 shows the composition of the steel of the present invention together with the composition of a rolled steel (SM50A) for a welded structure according to JIS G-3196.

Note, the steel tested of the present invention is obtained by heating a billet having the composition shown in Table 1 at 1200° C., hot-rolling the heated billet at a rolling-completing temperature of 950° C., and naturally cooling the rolled sheet to room temperature.

TABLE 1

| | C | Si | Mn | P | S | Al | Cr | Mo | Nb | Ceq | (wt %) Pcm |
|---|---|---|---|---|---|---|---|---|---|---|---|
| steel of present | 0.103 | 0.333 | 0.99 | 0.01 | 0.029 | 0.024 | 0.50 | 0.48 | 0.02 | 0.502 | 0.198 |

TABLE 1-continued

| | C | Si | Mn | P | S | Al | Cr | Mo | Nb | Ceq | (wt %) Pcm |
|---|---|---|---|---|---|---|---|---|---|---|---|
| invention | | | | | | | | | | | |
| comparative steel (SM50A) | 0.162 | 0.364 | 1.45 | 0.02 | 0.006 | 0.023 | — | — | — | 0.404 | 0.247 |

In FIG. 1, the stress (kgf/mm$^2$) is plotted on the ordinate and the temperature is plotted on the abscissa, and the solid line 1 indicates the change in the steel of the present invention and the broken line 2 indicates the change in the comparative steel (SM50A). Note, TS stands for the tensile strength and YP stands for the yield point.

As apparent from FIG. 1, at temperatures higher than 800° C., there is no difference in the yield strength, but at temperatures of 600° to 700° C., the steel of the present invention retains a yield strength twice as high as that of SM50A and the steel of the present invention has excellent characteristics as the construction steel.

Figure 2:
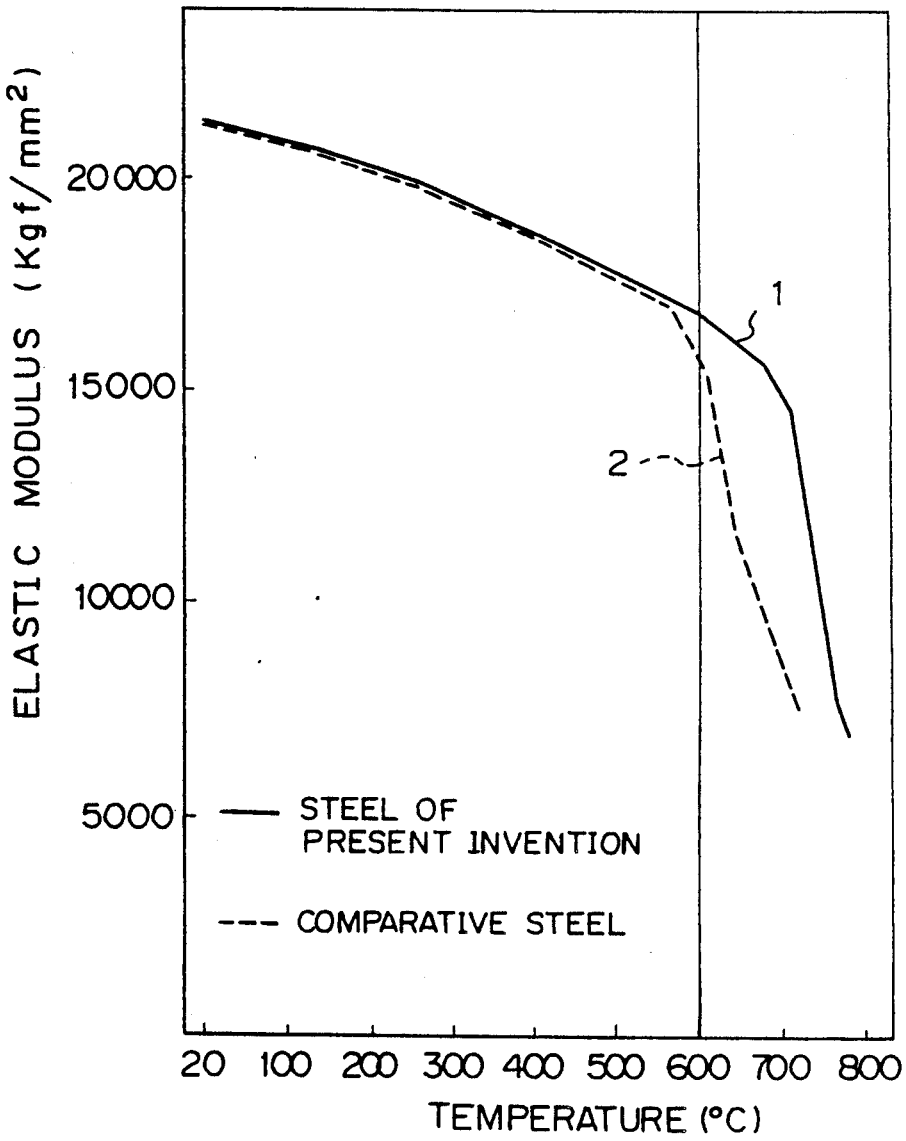
FIG. 2 is a graph comparing steels with respect to the elastic modulus at a high temperature.
Figure 3:
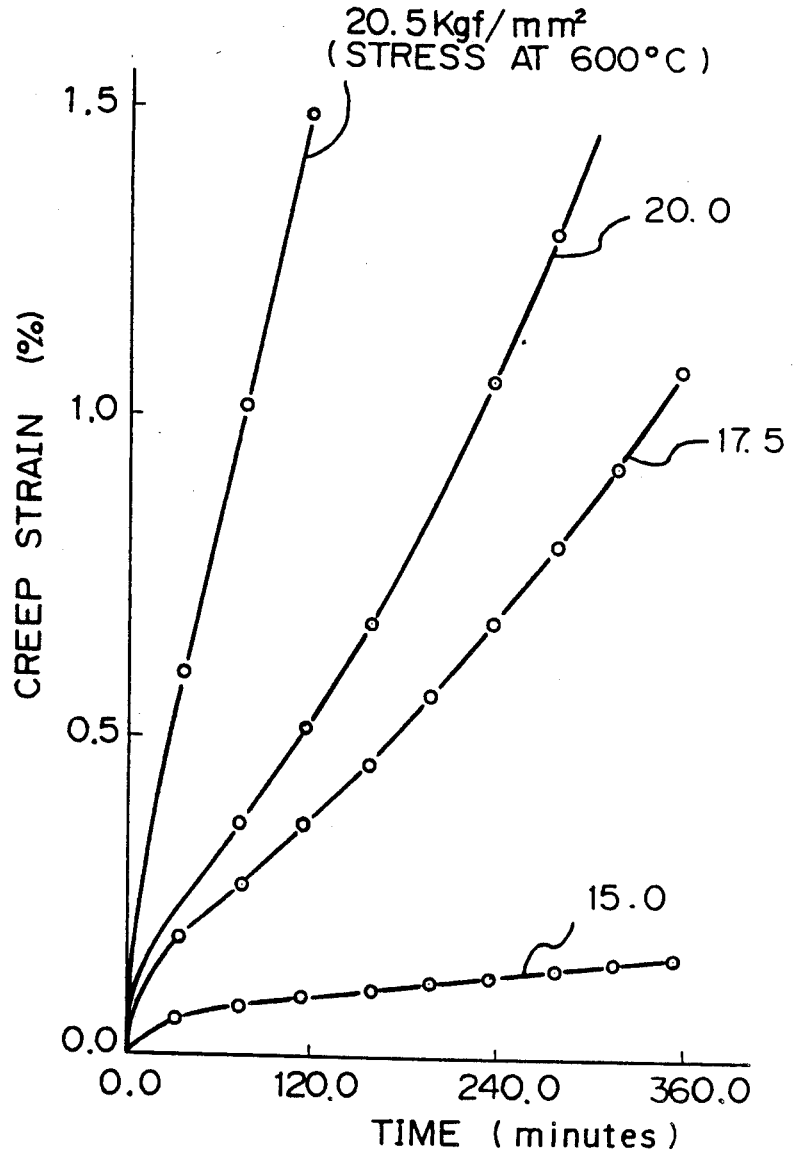
FIG. 3 is a graph illustrating creep characteristics of the steel of the present invention.
Figure 4:
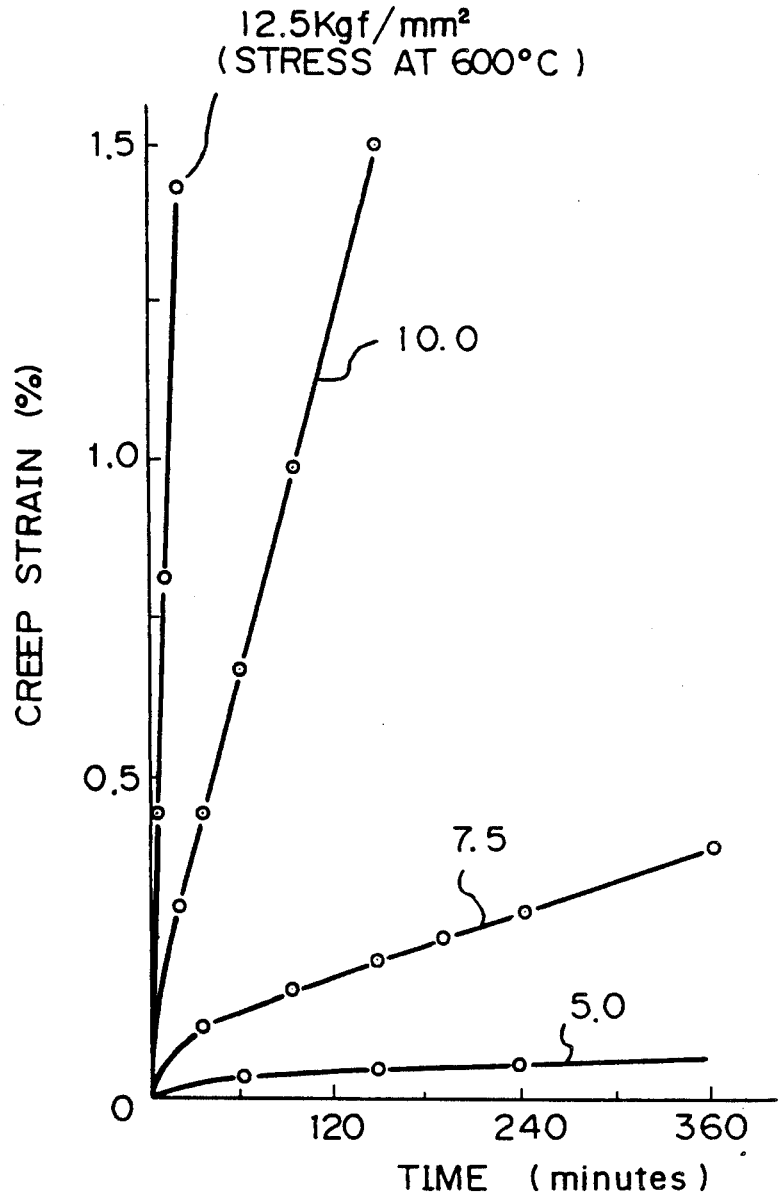
FIG. 4 is a graph illustrating creep characteristics of a comparative steel.

In FIG. 2, the elastic modulus (kgf/mm$^2$) is plotted on the ordinate and the temperature (°C.) is plotted on the abscissa, and the solid line 1 indicates the change in the steel of the present invention and the broken line 2 indicates the change in SM50A. In FIG. 3, the creep strain (%) is plotted on the ordinate and the time (minutes) is plotted on the abscissa, and the change in the steel of the present invention is illustrated, using the stress (kgf/mm$^2$) imposed on the test piece at 600° C. as the parameter. A similar change in SM50A is shown in FIG. 4.

As apparent from FIG. 2, in the steel of the present invention, the elastic modulus is drastically reduced if the temperature exceeds 700° C., but in SM50A, the elastic modulus is drastically reduced at a temperature of about 600° C. Moreover, as apparent from FIGS. 3 and 4, to the stress of 15 kgf/mm$^2$ at a temperature of 600° C., which is ordinarily imposed on a structural member such as a column or beam the advance of the creep strain in a maximum duration time of a fire, i.e., 3 hours, is strictly controlled in the steel of the present invention, but in the case of SM50A, if a stress of 10 kgf/mm$^2$ is imposed at a temperature of 600° C., the advance of the creep strain is extremely large. The fact that the elastic modulus is not reduced at a high temperature and the advance of the creep strain is small results in a reduced deformation of a building on a fire. Accordingly, it is understood that the steel of the present invention is superior to SM50A as the construction steel.

Similar results are obtained when the steel is compared with another comparative steel, SS41.

From the foregoing, it is obvious that, in the case of the steel of the present invention, the thickness of the fire-proof coating can be less than over the thickness in case of SM50A or SS41, if the fire load is the same. It also can be understood that the uncoated state is sufficient if the fire load is not large.

An embodiment in which an inorganic fibrous fire-resistant thin layer material is spread on the steel of the present invention will now be described.

Table 2 shows the coating thickness of fire-resistant materials necessary for controlling the steel temperature below 350° C. at the experiment stipulated in JIS A-1304.

Note, in the case of the steel material of the present invention, since elevation of the steel material to 600° C. is allowed, a thin coating thickness is sufficient, as shown in Table 3.

As apparent from the comparison of Tables 2 and 3, if the steel material of the present invention is used, the material cost and application cost of the fire-proofing coating can be drastically reduced.

TABLE 2

| Fire proofing coating method | | 1 hour | 2 hours | 3 hours* |
|---|---|---|---|---|
| sprayed rock wool (wet type) | column | 30 mm | 40 mm | 50 mm |
| | beam | 25 mm | 35 mm | 45 mm |
| sprayed rock wool (dry type) | column | 30 mm | 45 mm | 60 mm |
| | beam | 30 mm | 45 mm | 60 mm |
| ALC board | column | 25 mm | 50 mm | 75 mm |
| | beam | 25 mm | 50 mm | 75 mm |
| asbestos-calcium silicate board species 2, No. 2 | column | 25 mm | 40 mm | 55 mm |
| | beam | 25 mm | 35 mm | 50 mm |
| asbestos-calcium silicate board species 2, No. 2 | column | 25 mm | 45 mm | 60 mm |
| | beam | 25 mm | 40 mm | 55 mm |

*Fire-resisting time

TABLE 3

| Fire proofing coating method | | 1 hour | 2 hours | 3 hours* |
|---|---|---|---|---|
| sprayed rock wool (wet type) | column | 10 mm | 25 mm | 35 mm |
| | beam | 10 mm | 20 mm | 35 mm |
| sprayed rock wool (dry type) | column | 15 mm | 25 mm | 35 mm |
| | beam | 15 mm | 30 mm | 40 mm |
| ALC board | column | 15 mm | 30 mm | 50 mm |
| | beam | 15 mm | 30 mm | 50 mm |
| asbestos-calcium silicate board species 2, No. 2 | column | 15 mm | 25 mm | 35 mm |
| | beam | 15 mm | 25 mm | 35 mm |
| asbestos-calcium silicate board species 2, No. 2 | column | 15 mm | 25 mm | 40 mm |
| | beam | 15 mm | 25 mm | 40 mm |

*Fire-resisting time

Figure 5A:
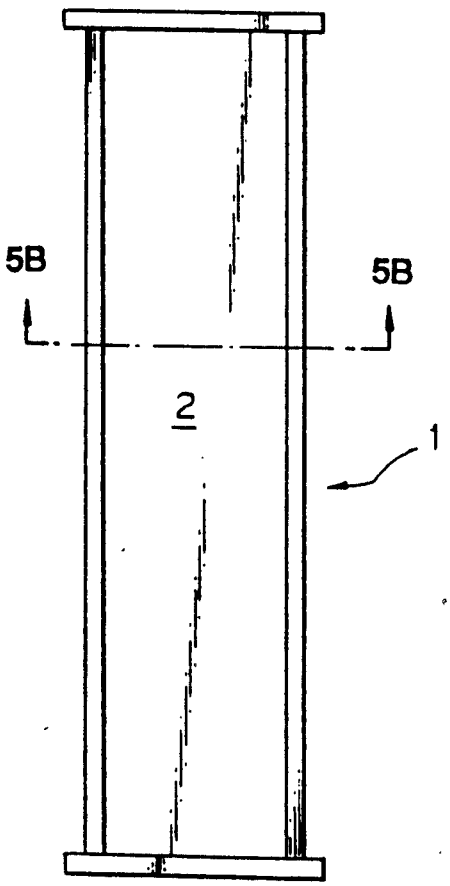
FIG. 5-A is a schematic elevation of a pillar formed by spreading a rock wool on an H-shape of the present invention by spraying (wet type) and FIG. 5-B is a view showing the section taken along the line A-A in FIG. 5-A.
Figure 5B:
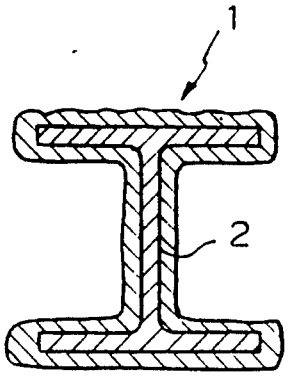

FIG. 5-A is a schematic elevation of a column formed by spreading sprayed rock wool[2] (wet type) shown in Table 3 on an H-shape 1 (300 mm×300 mm×10 mm×15 mm) of the present invention and FIG. 5-B shows the section taken along the line A-A.

Figure 6:
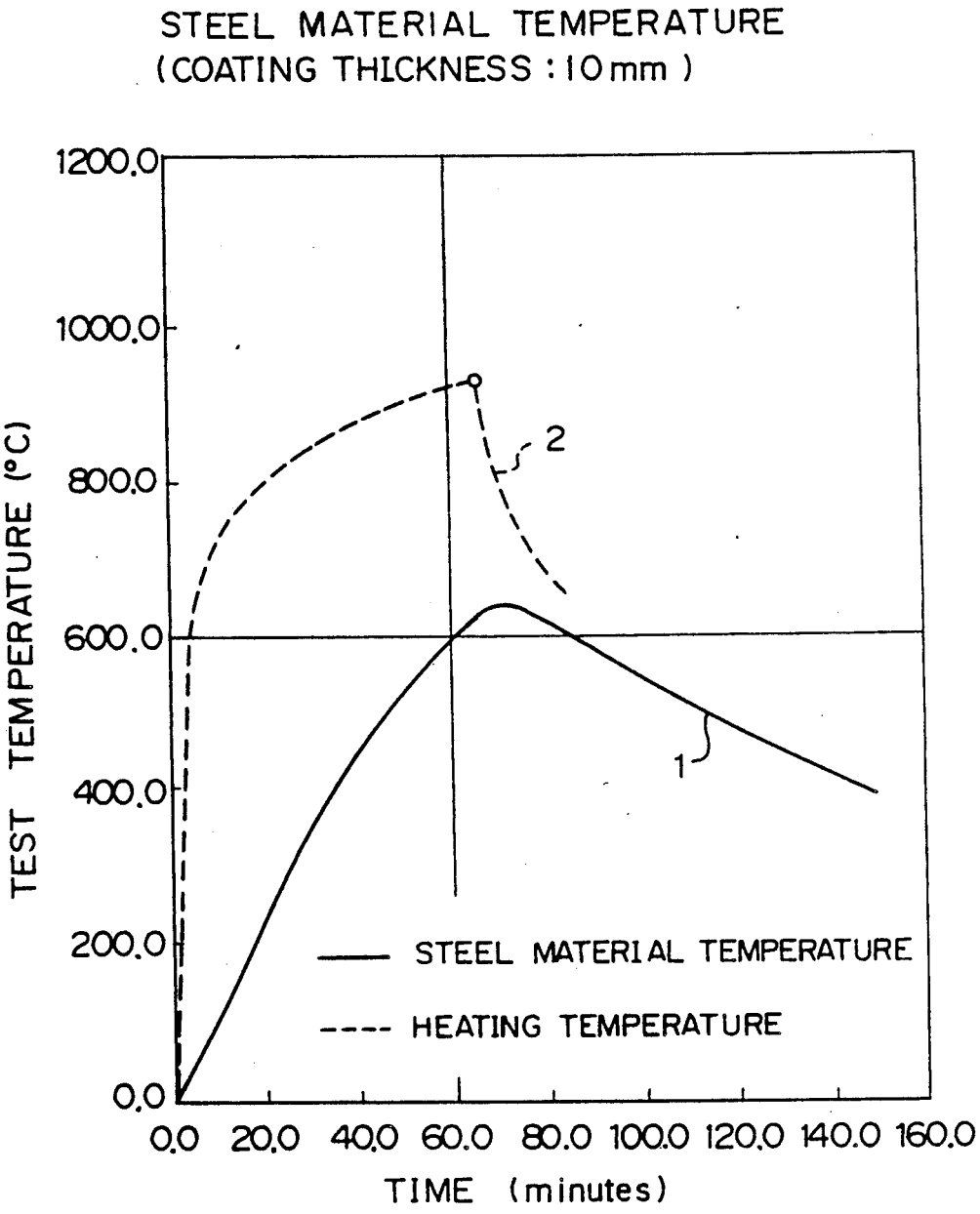
FIG. 6 is a graph showing the temperature elevation curve in the above-mentioned column.
Figure 7:
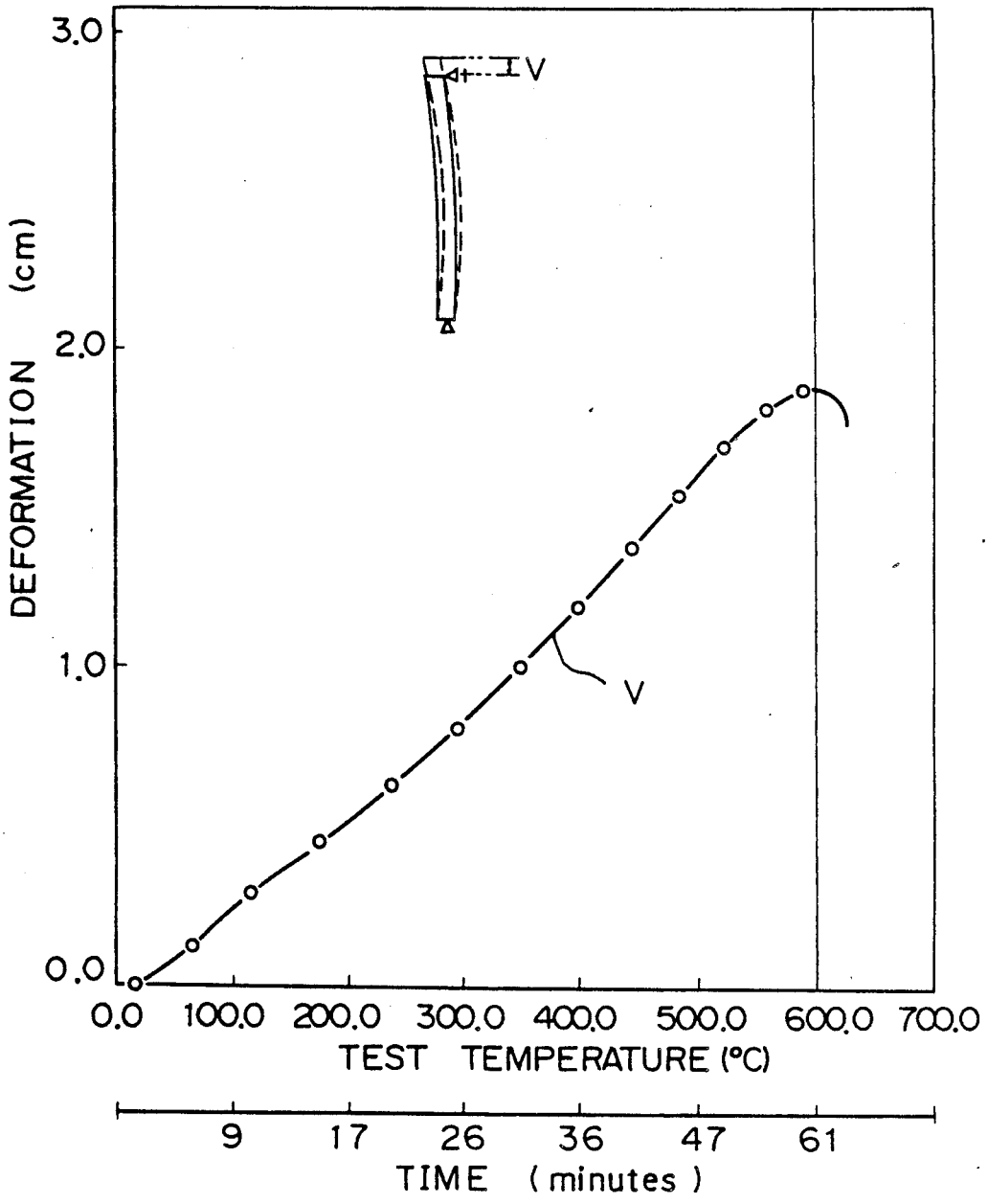
FIG. 7 is a graph showing a deformation of the above-mentioned column.

FIG. 6 illustrates the results of the experiment where the above-mentioned H-shape column is subjected to heating stipulated in JIS A-1304, a load customarily supported by a column of a building is imposed on the H-shape column and the time required for collapsing is determined. The temperature (°C.) is plotted on the ordinate and the time (minutes) is plotted on the abscissa. The solid line 1 indicates the steel material temperature of the column, and the broken line 2 indicates the heating temperature. In FIG. 7, the deformation (cm) is plotted on the ordinate and the time (minutes) is plotted on the abscissa, and the solid line indicates the change in the pillar. As apparent from FIGS. 6 and 7, the pillar formed of the steel material of the present invention is not collapsed until the temperature exceeds 600° C., and this pillar exerts a fire-resistance for more than 1 hour.

Similarly, FIG. 8-A is a schematic elevation illustrating a beam formed by spreading sprayed rock wool 4 (wet type) shown in Table 3 on an H-shape (400 mm ×200 mm×8 mm×13 mm) of the present invention, and FIG. 8-B is a view showing the section taken along the line A-A.

Figure 9:
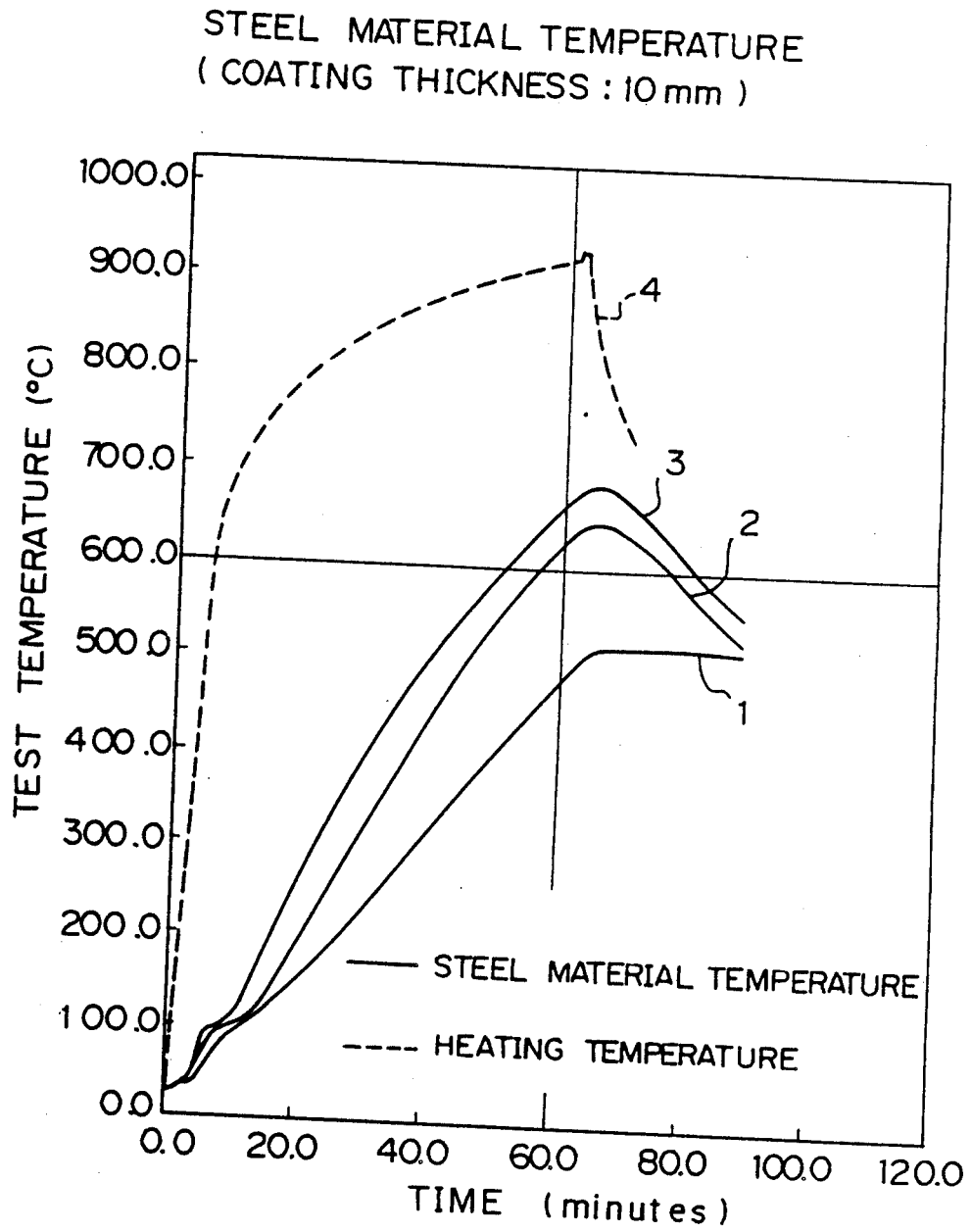
FIG. 9 is a graph showing the temperature elevation curve of the above-mentioned beam.
Figure 10:
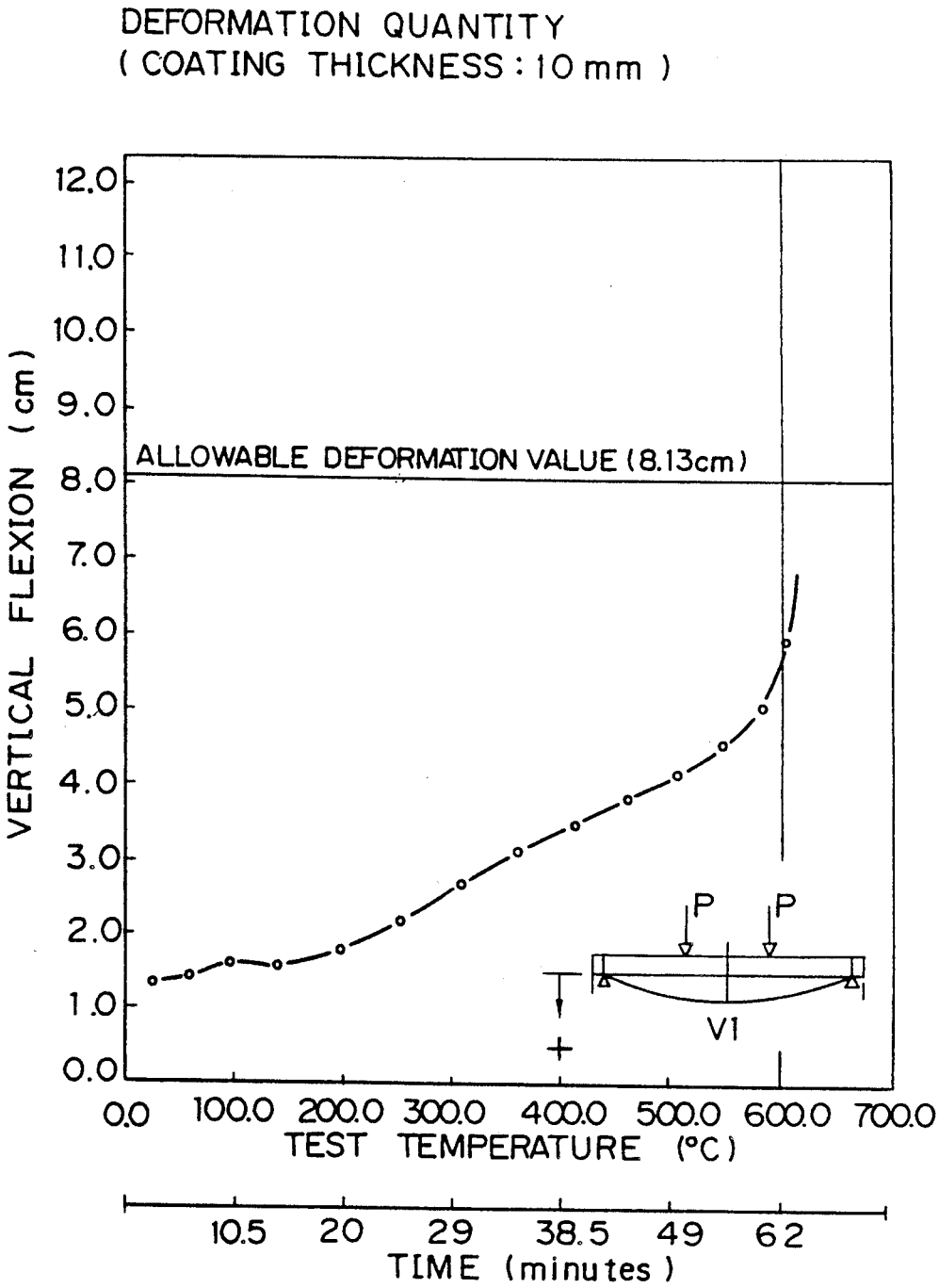
FIG. 10 is a graph showing a deformation of the above-mentioned beam.

FIG. 9 illustrates the results obtained in an experiment where the above-mentioned H-shape beam is subjected to heating stipulated in JIS A-1304, a load ordinarily supported by an ordinary beam of a building is imposed on the H-beam beam and the time required for collapsing is determined. The temperature (°C.) is plotted on the ordinate and the time (minutes) is plotted on the abscissa. The solid broken line 1 indicates the temperature of the upper flange 5, the solid broken line 2 indicates the temperature of the lower flange b, the solid broken line 3 indicates the temperature of the web 7, and the one-dot broken line 4 indicates the change of the heating temperature. In FIG. 10, the deformation (vertical deflection) (cm) is plotted on the ordinate and the time (minutes) is plotted on the abscissa. The solid broken line indicates the deformation at each point. As apparent from FIGS. 8 and 9, a beam obtained by applying sprayed rock wool (wet type) in a thickness of 10 mm on the steel material of the present invention is not collapsed until the temperature is elevated above 600° C., and the beam exhibits a fire-resistance for more than 1 hour. It also can be understood that the deformation quantity at 600° C. is within the allowable range.

Similar results are obtained by experiments using other fire-proofing coating materials.

The results of experiments made on samples formed by coating the steel material with highly heat-resistant paints are shown in Table 4.

TABLE 4

| | Primer Coated Amount (g/m²) | Highly Heat-Resistant Paint Coated Amount (g/m²) | Finish Paint Coated Amount (g/m²) | Steel Temperature 30 minutes (°C.) | 60 minutes (°C.) | 120 minutes (°C.) |
|---|---|---|---|---|---|---|
| Paint 1 | 200 | 1550 | 200 | 326 | 484 | |
| Paint 2 | 200 | first layer 1150 | | | | |
| | | second layer 1150 | 200 | | 336 | 595 |
| | | third layer 1150 | | | | |

Paints 1 and 2 are intumescence-type, highly heat-resistant paints (Pyrotex S30 and Pyrotex F60 supplied by Desowag, West Germany), and a square steel sheet of the present invention having a side of 220 mm and a thickness of 16 mm is used as a sample sheet.

The temperature of the steel material usually should not exceed 350° C. during a fire, and therefore, the fire-resistance did not last beyond 30-minutes and 60-minutes with the above paints 1 and 2. But, as shown in Table 4, the steel material of the present invention can obtain a yield strength at 600° C., and therefore, fire resistances of 60 minutes and 120-minutes can be obtained by the above paints 1 and 2. In other words, if the usual fire-resistance time is used for the present invention's steel materials, the painting process can be simplified. Namely, a steel material formed coating the steel of the present invention with a highly heat-resistant paint is economically advantageous and is effective for reducing the construction cost.

Figure 11:
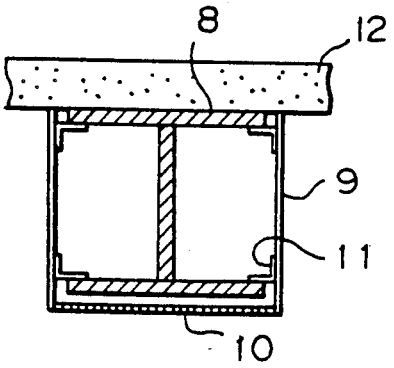
FIG. 11 is a schematic view showing the cross-section of a steel material having a heat-insulating shield plate attached thereto.
Figure 17A:
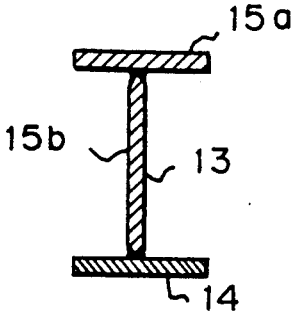
FIGS. 17-(A) through 17-(F) are schematic sectional views of build-up heat-resistant shaped steels of the present invention.
Figure 17B:
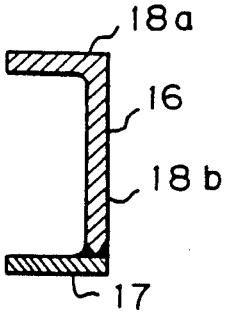
Figure 17C:
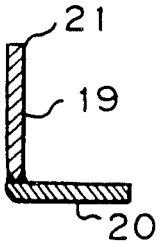
Figure 17D:
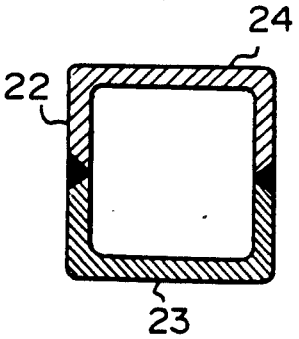
Figure 17E:
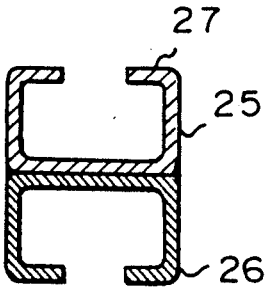
Figure 17F:
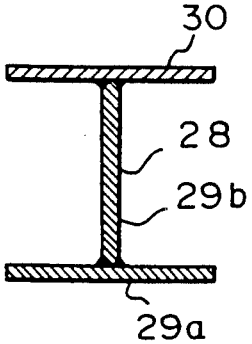

FIG. 11 is a schematic sectional view illustrating a beam 10 formed by enclosing an H-shape 8 of the present invention with a thin steel sheet (SS41) or a stainless steel sheet. The thin steel sheet 9 is fixed at a point apart by 10 to 50 mm from the H-beam 8 by a fitting 11. The beam 10 supports a concrete floor 12.

Figure 12:
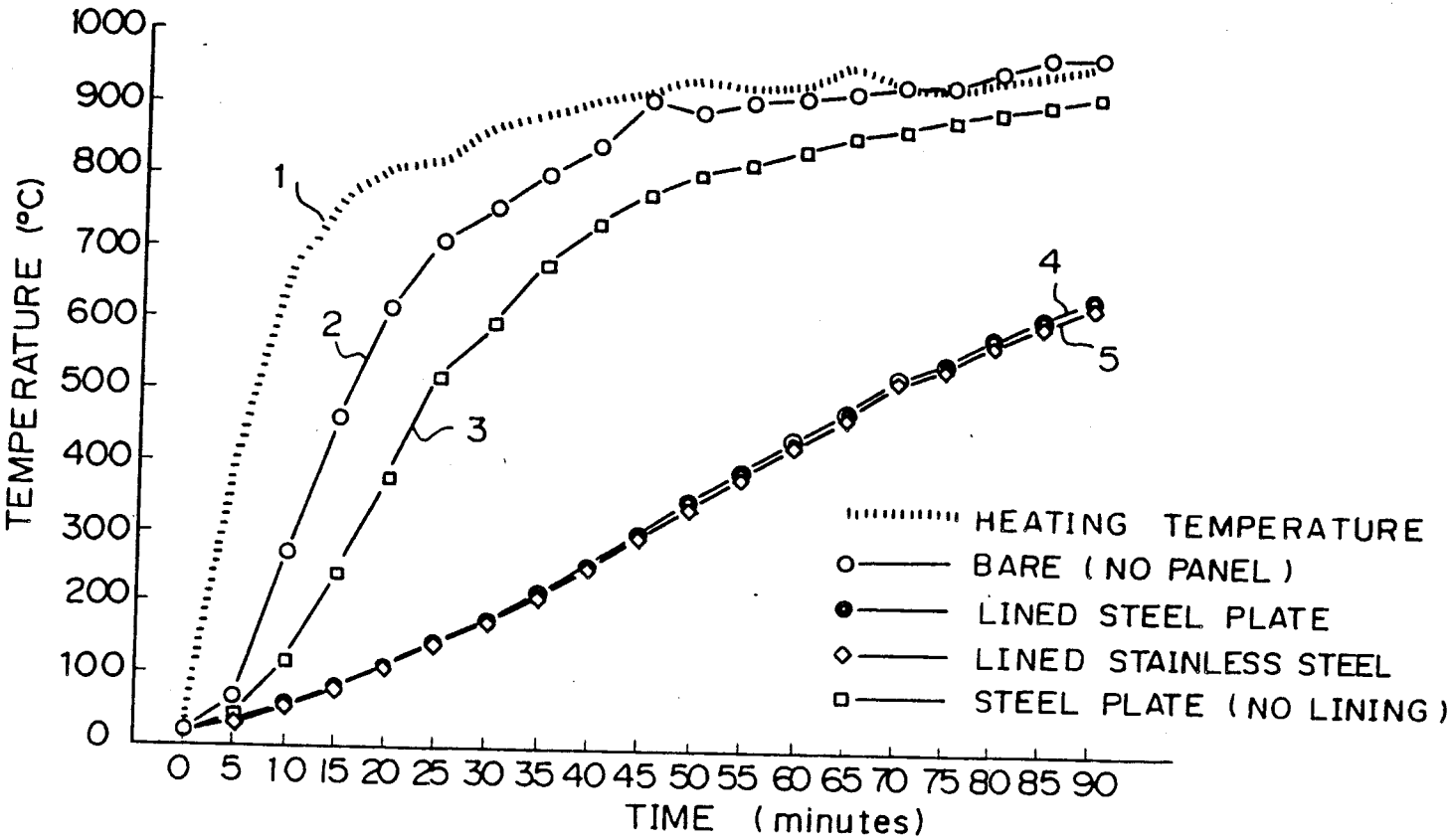
FIG. 12 is a graph showing the temperature elevation curve of the steel material shown in FIG. 11.

FIG. 12 shows the change of the steel material observed when the test sample shown in FIG. 11 is subjected to heating stipulated in JIS A-1304. In FIG. 12, the temperature (°C.) is plotted on the ordinate and the time (minutes) is plotted on the abscissa, and the solid broken line 1 indicates the heating temperature, the broken line 2 indicates the steel material temperature of the H-beam not enclosed with the thin steel sheet (SS41), the broken line 3 indicates the steel material temperature of the H-beam enclosed with the thin steel sheet (SS41), the broken line 4 indicates the steel material temperature of the H-beam having a light fire-proofing coating formed on the inner side of the surrounding thin steel sheet (SS41) and the broken line 5 indicates the steel material temperature of the H-beam having a light fire-proofing coating formed on the inner side of the thin steel sheet (stainless steel).

As apparent from FIG. 12, compared with the steel material temperature of the H-beam not enclosed with the thin steel sheet (SS41), the steel material temperature of the H-beam enclosed with the thin steel sheet (SS41) is characterized in that the rise of the temperature within 30 minutes is small, and the steel material retains its strength until the temperature exceeds 600° C. Accordingly, where the fire load is low and the required heat-resistant performance time is short, the steel material of the present invention can be used in the uncoated state by enclosing the steel material with the thin steel sheet (SS41). If the fire load is high and the required heat-resistant performance time is long, the H-beam can be used in the uncoated state by forming a light fire-proofing coating on the inner side of the thin steel sheet (SS41). Not only the above-mentioned thin steel sheet 9 but also a metal sheet having a heat-insulating effect, such as a thin stainless steel sheet, a thin titanium sheet or an aluminum sheet, is called "heat-insulating shield plate".

The steel material of the present invention having the above-mentioned heat-insulating shield plate can be attached very easily without such a difficult in-situ operation as spraying of a fire-proofing coating material, and therefore, this steel material of the present invention can be used economically advantageously.

Figure 13:
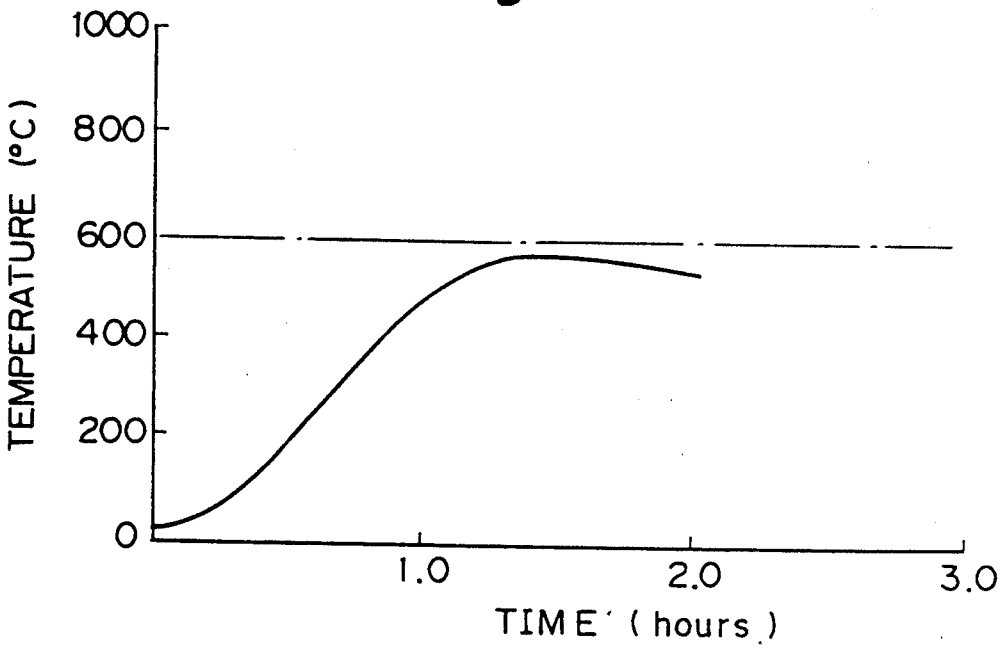
FIGS. 13 and 14 are graphs showing temperature elevation curves of a concrete-filled steel tube and a deck plate.

FIG. 13 is a graph illustrating the change of the steel material temperature observed when concrete is filled in a square steel tube according to the present invention, a fibrous fire-proofing material composed mainly of rock wool is coated in a thickness of 5 mm on the surface by the wet spraying and the coated steel tube is subjected for 1 hour to a fire-proofing test according to JIS A-1304. The intended objects can be obtained by the steel material of the present invention even if the thickness of the fire-proofing coating layer is as small as mentioned above.

Figure 14:
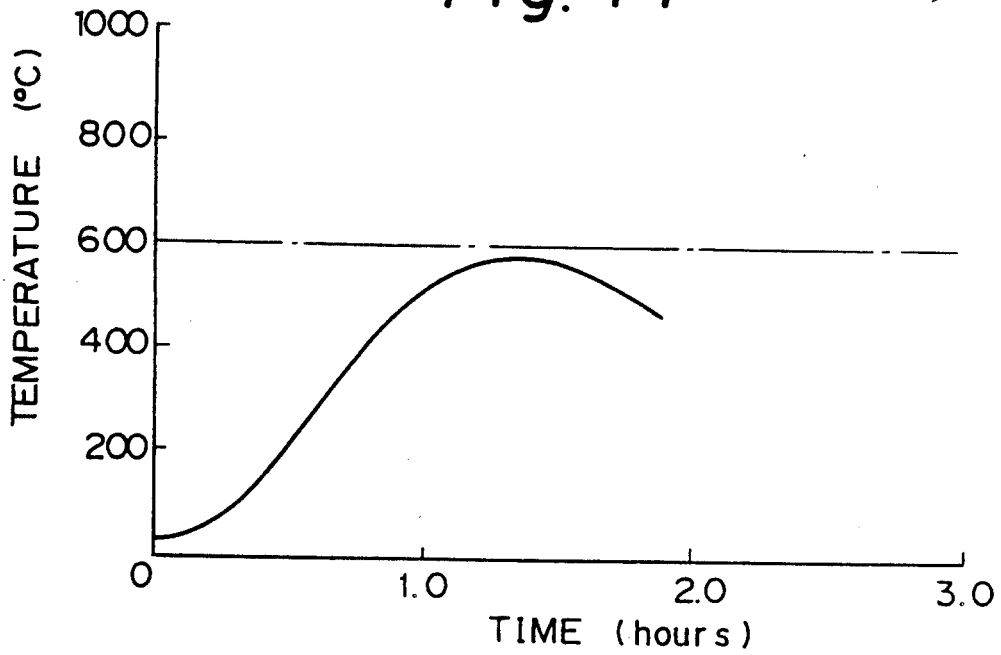

The graph of FIG. 14 illustrates results obtained when the steel sheet of the present invention is formed into a deck plate, a fibrous fire-proofing material composed mainly of rock wool is wet-sprayed on the back surface of the deck plate and the coated deck plate is subjected for 1 hour to a fire-proofing test according to JIS A-1304. Since the temperature of the deck plate per se does not exceed 600° C., it is confirmed that the steel material of the present invention can be effectively used as a fire-proofing steel material.

Figure 15:
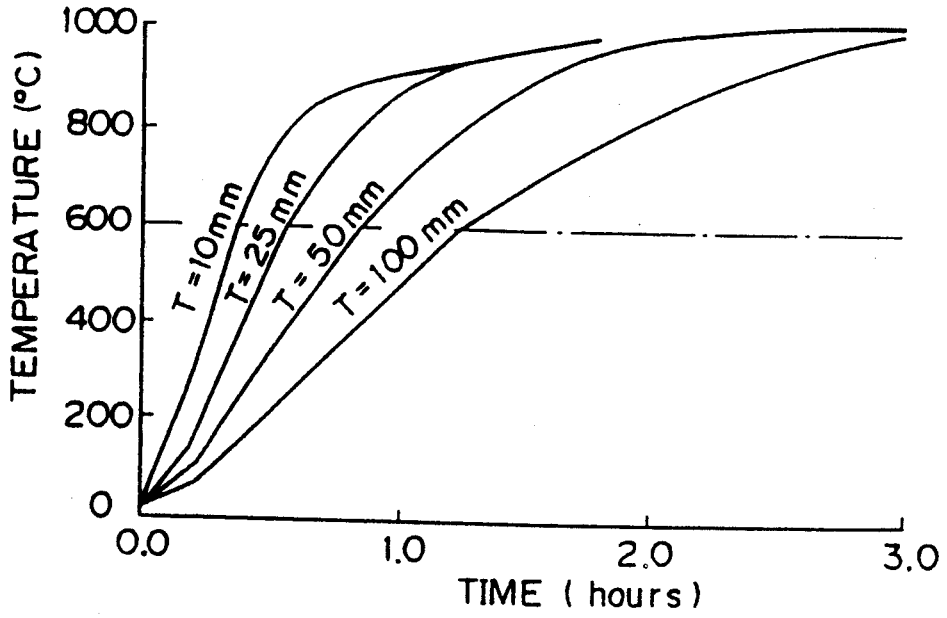
FIGS. 15 and 16 are graphs showing temperature elevation curves of uncoated steel frames differing in emissivity.
Figure 16:
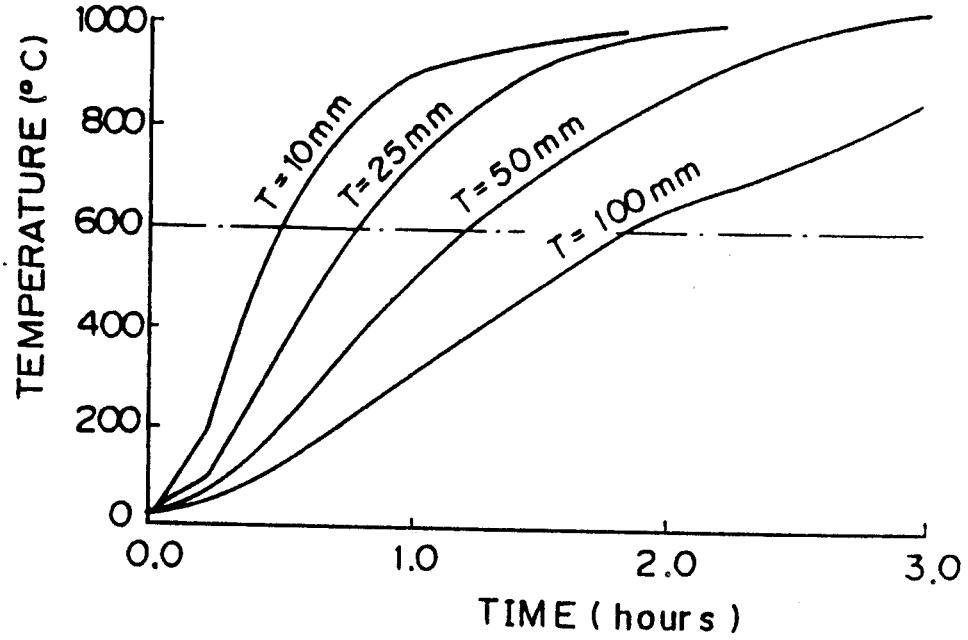

FIGS. 15 and 16 are graphs illustrating the elevation of the temperature observed when an uncoated steel frame is subjected to a fire test at emissivities of 0.7 and 0.4. Note, T stands for the sheet thickness.

As apparent from FIGS. 15 and 16, if the plate thickness is 100 mm, the steel material of the present invention does not cause problems in the uncoated state in connection with the 1-hour fire-proofing performance.

From the results of our experiments, it has been confirmed that, even if the emissivity is 0.7, the 1-hour fire-proofing performance is satisfactory if the plate thickness is at least 70 mm and that if an ultra-thin metal sheet such as an aluminum foil is spread on the steel material of the present invention, the steel material can be used in the state not coated with a heat-insulating fire-proofing material if the plate thickness is at least 40 mm.

If the steel material of the present invention is used as a part of a construction material of a build-up shaped steel as an example of the construction steel material, in connection with the design requirements, there are no dimensional limitations as imposed on rolled shaped steels, and the dimensional allowance is very broad and demands can be flexibly met. Therefore, according to this example of the present invention, a heat-resistant steel material having excellent fire-proofing characteristics and economically advantageous can be provided. This example will now be described with reference to the accompanying drawings.

FIGS. 17-A through 17-F are schematic sectional views illustrating a build-up heat-resistant shaped steel according to this example of the present invention. FIG. 17-A is a sectional view of an I-shaped steel 1 comprising a flange 14 composed of a heat-resistant steel material of the present invention, and a flange **15*a* and a web 15*b***, which are composed a rolled steel material for general construction according to JIS G-3101.

FIG. 17-B is a sectional view of a channel steel 16 comprising a flange 17 composed of a heat-resistant steel material of the present invention, and a flange **18*a* and a web 18*b***, which are composed of a rolled steel material for welded construction according to JIS G-3106.

FIG. 17-C is a sectional view of an angle steel a comprising a flange 20 composed of a heat-resistant steel material of the present invention and a flange 21 composed of a weather-proof hot-rolled steel material for welded construction according to JIS G-3114.

FIG. 17-D is a sectional view of a square tube 22 comprising a channel steel 23 composed of a heat-resistant steel material of the present invention and a channel steel 24 composed of a highly weather-proof rolled steel material according to JIS G-3125.

FIG. 17-E is a sectional view of a column 25 comprising a lip channel steel 26 composed of a heat-resistant steel material of the present invention and a lip channel steel 27 composed of an ordinary construction steel material according to JIS G-3101.

FIG. 17-F is a sectional view of an H-beam 28 comprising a flange **29*a* and a web 29*b*, which are composed of a heat-resistant steel material of the present invention, and a flange 30** composed of an ordinary construction material according to JIS G-3101.

One characteristic feature of the present invention, that Mo and Nb are added in combination to a low-C and Low-Mn steel, has been described in detail. Other characteristic features of the present invention will now be described. It was found that, where Mo alone is added to a low-C and low-Mn steel, if the conditions for cooling after the hot rolling are appropriately controlled, the obtained steel has not only an appropriate yield strength at normal temperature but also a high yield strength at high temperatures.

More specifically, a steel having such characteristics is manufactured according to a process comprising heating a slab having a composition formed by adding Mo to the low-C and low-Mn steel at a high temperature, finishing rolling at a relatively high temperature, starting water cooling in the intermediate stage, where the ferrite proportion is 20 to 50% (the temperature range of from $Ar_3$-20° C. to $Ar_3$-100° C.), during the transformation to ferrite from austenite at the subsequent air-cooling stopping the water cooling to an arbitrary temperature lower than 550° C. (in the temperature range from 550° C. to room temperature), and then being air cooled.

In the steel obtained according to this process, the ratio of the yield strength at 600° C. to the yield strength normal temperature is high. This is because the microstructure of the steel added an appropriate amount of Mo comprises from a mixed structure of relatively large ferrite and bainite. In contrast, in a steel composed mainly of bainite, since the yield strength at normal temperature is much higher than the yield strength at 600° C., specifications of strength at normal temperature are not satisfied. In a steel composed mainly of ferrite, a balance between the normal temperature yield strength and the high-temperature yield strength is relatively good, but the amount of the strength-increasing element such as Mo must be increased over the amount in the steel of the present invention.

Namely, it was found that the utilization of the ferrite-bainite microstructure is effective for improving the high-temperature strength. This steel of the present invention has a low yield ratio and an excellent earthquake resistance. This advantage is also due to the fact that the microstructure is a mixed structure comprising 20 to 50% of relatively large ferrite and bainite. The characteristic alloying elements of the present invention and the added amounts thereof will now be described.

Mo increases the strength by both precipitation hardening and solid solution hardening. The amount of Mo necessary for obtaining the high-temperature strength is changed according to other base compositions or microstructure. If the alloying elements and manufacturing process are within the scope of the present invention, the intended effect cannot be obtained at an Mo content lower than 0.2%, but if the Mo content is too high, the weldability is lowered and the toughness of the weld heat affected zone (HAZ) is deteriorated. Accordingly, the upper limit of the Mo content is set at 0.7%, and the lower limit of the Mo content is set at 0.2%. The kinds and amounts of the elements other than Mo can be the same as in case of the combined addition of Mo and Nb.

In this embodiment, Nb can be added as an optional element in an amount of 0.005 to 0.04% for formation of a carbonitride Nb(CN), whereby the high-temperature strength can be further improved.

To satisfy the requirements of the normal temperature specification stipulated for a rolled steel for welded structure (JIS G-3106) and maintain a high yield strength at a high temperature of 600° C., not only the steel composition but also the conditions for heating, rolling and cooling the steel must be appropriately controlled, and especially, to increase the high-temperature yield strength by the addition of Mo, the Mo must be dissolved during the heating step. For this purpose, the lower limit of the temperature for heating a slab having the above-mentioned composition is set at 1100° C. If the heating temperature is too high, the resultant ferrite grain size becomes coarser and the low-temperature toughness is degraded. Accordingly, the upper limit of the heating temperature is set at 1300° C. Then, the heated slab is subjected to hot rolling, and the finish rolling temperature is adjusted to a level not lower than 800° C., to prevent precipitation of the carbide during the rolling. If Mo is precipitated in the γ-region, the size of the precipitate is increased and the high-temperature yield strength is drastically degraded. The upper limit of the finish rolling temperature is set at 1000° C. At a temperature exceeding this upper limit, the rolling becomes difficult. After completion of the rolling, air cooling is performed to $Ar_3$-20° C. to $Ar_3$-100° C., and water cooling is carried out from this temperature to an arbitrary temperature lower than 550° C., and then the steel is naturally cooled. Namely, if cooling is performed just after rolling, a high strength can be obtained but the balance between the strength at normal temperature and the strength at a high temperature of 600° C. is too low, and even if a high strength at 600° C. is obtained, the strength at normal temperature fails to satisfy the standard requirement. At the temperature between $Ar_3$-20° C. and $Ar_3$-100° C., the austenite to ferrite transformation proceeds and the ferrite fraction increases to 20 to 50%. If cooling is started at this temperature and is stopped at an arbitrary temperature lower than 550° C. the microstructure is changed to a mixed structure comprising 20 to 50% of ferrite and bainite, and a high strength is attained and the yield ratio is controlled to a low level while maintaining a good balance between the strength at normal temperature and the strength at 600° C.

A slab having a composition shown in Table 5 is heated at 1150° C. and hot-rolling is finished at a temperature of 836° C. Then the steel is air-cooled to 760° C. and from this temperature, is rapidly cooled to 454° C. at a cooling rate of 27° C./sec. After stopping the cooling, the steel is naturally cooled to obtain a highly fire-proof steel. When the obtained steel material is subjected to the mechanical test, fire-proofing coating test, H-shape column and beam fire-proofing test, heat-resistant paint test and heat-insulating shield plate described hereinbefore with respect to the above-mentioned steel in which Mo and Nb are added in combination, results can be obtained similar to the results obtained in the Mo- and Nb-alloyed steel.

TABLE 5

| | C | Si | Mn | P | S | Al | Mo | Nb | Ni | Cu | Cr | V | Ti | Ceq | Pcm |
|---|---|---|---|---|---|---|---|---|---|---|---|---|---|---|---|
| steel of present invention | 0.042 | 0.24 | 1.22 | 0.012 | 0.004 | 0.022 | 0.54 | — | — | — | — | — | 0.011 | 0.390 | 0.147 |
| comparative steel (SM50A) | 0.162 | 0.364 | 1.45 | 0.020 | 0.006 | 0.023 | — | — | — | — | — | — | — | 0.404 | 0.247 |

The present invention will now be described in detail with reference to the following examples.

EXAMPLE 1

Steel plates (having a thickness of 20 to 50 mm) having various composition were manufactured by a process using an LD converter, continuous casting and plate-rolling, and the normal temperature strength, the high-temperature strength and the like were examined.

In Tables 6, 7 and 8, the compositions of the steels of the present invention are compared with those of the comparative steels, and the mechanical properties according to the heating, rolling and cooling conditions are shown in Tables 9 through 13.

As apparent from Tables 9 through 13, all of the steels of the present invention have an appropriate normal temperature strength and a good high-temperature strength, but in all of the comparative steels, the normal temperature strength is too high or too low and the ratio of the strength at 600° C. to the normal temperature strength is low, and thus the comparative steels are not suitable as a fire-proof construction steel.

TABLE 6

| Sorting of Steels | | Chemical Composition (% by weight) | | | | | | | | | | | |
|---|---|---|---|---|---|---|---|---|---|---|---|---|---|
| | | C | Si | Mn | P | S | Al | Mo | Nb | Ni | Cu | Cr | V |
| steels | 1 | 0.045 | 0.32 | 0.85 | 0.013 | 0.006 | 0.023 | 0.53 | 0.013 | — | — | — | — |

TABLE 6-continued

| | | | | | | | | | | | | | |
|---|---|---|---|---|---|---|---|---|---|---|---|---|---|
| of | 2 | 0.048 | 0.30 | 0.85 | 0.012 | 0.005 | 0.021 | 0.50 | 0.015 | — | — | — | — |
| pre- | 3 | 0.047 | 0.33 | 0.84 | 0.010 | 0.002 | 0.024 | 0.44 | 0.020 | — | — | — | — |
| sent | 4 | 0.044 | 0.53 | 0.86 | 0.015 | 0.002 | 0.025 | 0.45 | 0.020 | — | — | — | — |
| inven- | 5 | 0.054 | 0.23 | 0.82 | 0.008 | 0.004 | 0.052 | 0.42 | 0.008 | — | — | — | — |
| tion | 6 | 0.056 | 0.24 | 0.73 | 0.007 | 0.003 | 0.023 | 0.52 | 0.012 | — | — | — | — |
| | 7 | 0.053 | 0.25 | 0.75 | 0.006 | 0.002 | 0.026 | 0.50 | 0.014 | — | — | — | — |
| | 8 | 0.055 | 0.24 | 0.76 | 0.016 | 0.002 | 0.027 | 0.51 | 0.013 | — | — | — | — |
| | 9 | 0.060 | 0.11 | 0.52 | 0.015 | 0.004 | 0.025 | 0.53 | 0.013 | — | — | — | — |
| | 10 | 0.062 | 0.13 | 0.54 | 0.017 | 0.002 | 0.024 | 0.52 | 0.010 | 0.15 | 0.20 | — | — |
| | 11 | 0.061 | 0.13 | 0.53 | 0.017 | 0.004 | 0.022 | 0.50 | 0.010 | — | — | 0.35 | — |
| | 12 | 0.064 | 0.16 | 0.52 | 0.013 | 0.004 | 0.020 | 0.54 | 0.008 | — | — | — | 0.035 |

| Sorting of Steels | | Chemical Composition (% by weight) | | | | | | | |
|---|---|---|---|---|---|---|---|---|---|
| | | Ti | Zr | B | Ca | REM | N | Ccq | Pcm |
| steels | 1 | 0.011 | — | — | — | — | 0.0022 | 0.332 | 0.133 |
| of | 2 | — | 0.007 | — | — | — | 0.0025 | 0.327 | 0.134 |
| pre- | 3 | 0.015 | — | — | 0.0027 | — | 0.0034 | 0.311 | 0.129 |
| sent | 4 | 0.013 | — | — | — | 0.0015 | 0.0032 | 0.322 | 0.135 |
| inven- | 5 | 0.007 | — | 0.0006 | — | — | 0.0025 | 0.305 | 0.134 |
| tion | 6 | — | 0.015 | — | — | — | 0.0027 | 0.318 | 0.135 |
| | 7 | 0.009 | — | — | — | 0.0023 | 0.0030 | 0.313 | 0.132 |
| | 8 | 0.023 | — | — | 0.0046 | — | 0.0044 | 0.319 | 0.135 |
| | 9 | — | 0.006 | — | — | — | 0.0022 | 0.284 | 0.125 |
| | 10 | 0.013 | — | — | 0.0015 | — | 0.0027 | 0.291 | 0.140 |
| | 11 | 0.092 | — | — | — | — | 0.0016 | 0.350 | 0.143 |
| | 12 | — | 0.008 | — | — | — | 0.0019 | 0.295 | 0.135 |

Ccq = 1/6 Mn + 1/24 Si + 1/40 Ni + 1/5 Cr + ¼ Mo + 1/14 V
Pcm = C + 1/30 Si + 1/20 Mn + 1/20 Cu + 1/60 Ni + 1/20 Cr + 1/15 Mo + 1/10 V + 5 B

TABLE 7

| Sorting of Steels | | Chemical Composition (% by weight) | | | | | | | | | | | |
|---|---|---|---|---|---|---|---|---|---|---|---|---|---|
| | | C | Si | Mn | P | S | Al | Mo | Nb | Ni | Cu | Cr | V |
| steels | 13 | 0.085 | 0.16 | 1.42 | 0.007 | 0.003 | 0.021 | 0.48 | 0.025 | — | — | 0.45 | — |
| of | 14 | 0.083 | 0.15 | 0.73 | 0.006 | 0.001 | 0.026 | 0.53 | 0.023 | — | — | — | — |
| pre- | 15 | 0.083 | 0.17 | 1.56 | 0.008 | 0.002 | 0.024 | 0.52 | 0.024 | — | — | — | — |
| sent | 16 | 0.084 | 0.16 | 0.73 | 0.007 | 0.002 | 0.032 | 0.48 | 0.025 | — | — | — | — |
| inven- | 17 | 0.082 | 0.15 | 0.75 | 0.008 | 0.004 | 0.023 | 0.52 | 0.011 | — | — | — | 0.020 |
| tion | 18 | 0.092 | 0.43 | 0.98 | 0.006 | 0.004 | 0.024 | 0.51 | 0.020 | — | — | — | — |
| | 19 | 0.092 | 0.22 | 0.96 | 0.005 | 0.002 | 0.026 | 0.50 | 0.013 | — | 0.35 | 0.25 | — |
| | 20 | 0.090 | 0.26 | 1.40 | 0.007 | 0.003 | 0.023 | 0.44 | 0.015 | — | — | 0.48 | 0.065 |
| | 21 | 0.091 | 0.25 | 1.03 | 0.006 | 0.002 | 0.026 | 0.42 | 0.020 | 0.32 | 0.33 | 0.53 | — |
| | 22 | 0.104 | 0.22 | 0.65 | 0.005 | 0.003 | 0.022 | 0.63 | 0.015 | — | — | 0.34 | — |
| | 23 | 0.103 | 0.24 | 0.66 | 0.007 | 0.002 | 0.023 | 0.45 | 0.030 | 0.15 | — | 0.15 | — |
| | 24 | 0.107 | 0.27 | 0.55 | 0.006 | 0.003 | 0.027 | 0.42 | 0.035 | — | — | 0.95 | — |
| | 25 | 0.105 | 0.25 | 0.57 | 0.003 | 0.002 | 0.025 | 0.45 | 0.010 | 0.25 | 0.94 | — | — |

| Sorting of Steels | | Chemical Composition (% by weight) | | | | | | | |
|---|---|---|---|---|---|---|---|---|---|
| | | Ti | Zr | B | Ca | REM | N | Ccq | Pcm |
| steels | 13 | 0.012 | — | — | — | — | 0.0022 | 0.538 | 0.216 |
| of | 14 | 0.010 | — | — | 0.0035 | — | 0.0032 | 0.343 | 0.160 |
| pre- | 15 | — | 0.013 | — | — | — | 0.0021 | 0.480 | 0.201 |
| sent | 16 | 0.87 | — | — | — | 0.0021 | 0.0032 | 0.332 | 0.158 |
| inven- | 17 | — | 0.011 | — | — | — | 0.0018 | 0.345 | 0.161 |
| tion | 18 | — | — | — | — | — | 0.0015 | 0.401 | 0.189 |
| | 19 | 0.012 | — | — | 0.0032 | — | 0.0034 | 0.436 | 0.211 |
| | 20 | — | 0.007 | — | — | — | 0.0023 | 0.542 | 0.224 |
| | 21 | 0.008 | — | — | 0.0040 | — | 0.0036 | 0.492 | 0.227 |
| | 22 | 0.013 | — | — | — | 0.0023 | 0.0024 | 0.447 | 0.203 |
| | 23 | — | 0.009 | — | — | — | 0.0019 | 0.369 | 0.184 |
| | 24 | 0.007 | — | — | — | — | 0.0022 | 0.505 | 0.219 |
| | 25 | 0.008 | — | — | — | 0.0036 | 0.0034 | 0.329 | 0.223 |

Ccq = 1/6 Mn + 1/24 Si + 1/40 Ni + 1/5 Cr + ¼ Mo + 1/14 V
Pcm = C + 1/30 Si + 1/20 Mn + 1/20 Cu + 1/60 Ni + 1/20 Cr + 1/15 Mo + 1/10 V + 5 B

TABLE 8

| Sorting of Steels | | Chemical Composition (% by weight) | | | | | | | | | | | |
|---|---|---|---|---|---|---|---|---|---|---|---|---|---|
| | | C | Si | Mn | P | S | Al | Mo | Nb | Ni | Cu | Cr | V |
| steels | 26 | 0.120 | 0.23 | 0.52 | 0.007 | 0.002 | 0.023 | 0.67 | 0.025 | 0.20 | 0.75 | — | — |
| of | 27 | 0.123 | 0.22 | 1.26 | 0.005 | 0.002 | 0.026 | 0.65 | 0.035 | — | — | 0.45 | — |
| pre- | 28 | 0.118 | 0.15 | 0.54 | 0.004 | 0.002 | 0.003 | 0.66 | 0.025 | — | — | — | 0.035 |
| sent | 29 | 0.117 | 0.17 | 0.55 | 0.006 | 0.002 | 0.032 | 0.65 | 0.020 | 0.20 | 0.45 | — | |
| inven- | 30 | 0.142 | 0.16 | 0.52 | 0.004 | 0.002 | 0.032 | 0.62 | 0.033 | — | — | — | 0.045 |
| tion | 31 | 0.145 | 0.15 | 0.53 | 0.005 | 0.003 | 0.024 | 0.63 | 0.025 | — | — | 0.50 | — |

TABLE 8-continued

| | | | | | | | | | | | | | |
|---|---|---|---|---|---|---|---|---|---|---|---|---|---|
| | 32 | 0.146 | 0.13 | 1.54 | 0.013 | 0.003 | 0.032 | 0.62 | 0.031 | 0.45 | 0.30 | 0.30 | — |
| | 33 | 0.087 | 0.32 | 1.26 | 0.013 | 0.003 | 0.022 | 0.46 | 0.023 | — | — | 0.22 | — |
| | 34 | 0.076 | 0.22 | 1.15 | 0.009 | 0.003 | 0.025 | 0.52 | 0.020 | — | — | — | — |
| | 35 | 0.116 | 0.23 | 0.97 | 0.010 | 0.003 | 0.023 | 0.51 | 0.022 | — | — | 0.31 | — |
| compar- | 36 | 0.046 | 0.35 | 0.83 | 0.012 | 0.004 | 0.025 | 0.22 | 0.013 | — | — | — | — |
| ative steels | 37 | 0.048 | 0.32 | 0.82 | 0.015 | 0.005 | 0.022 | 0.52 | — | — | — | — | — |

| | Sorting of Steels | | Chemical Composition (% by weight) | | | | | | | |
|---|---|---|---|---|---|---|---|---|---|---|
| | | | Ti | Zr | B | Ca | REM | N | Ccq | Pcm |
| | steels | 26 | 0.012 | — | — | 0.0023 | — | 0.0030 | 0.389 | 0.239 |
| | of | 27 | — | 0.006 | — | — | — | 0.0023 | 0.595 | 0.259 |
| | pre- | 28 | 0.006 | — | — | 0.0015 | — | 0.0027 | 0.382 | 0.198 |
| | sent | 29 | 0.010 | — | 0.0015 | — | — | 0.0018 | 0.473 | 0.239 |
| | inven- | 30 | — | — | — | — | — | 0.0015 | 0.394 | 0.219 |
| | tion | 31 | — | — | 0.0008 | — | — | 0.0023 | 0.497 | 0.248 |
| | | 32 | — | 0.010 | — | — | — | 0.0027 | 0.468 | 0.256 |
| | | 33 | 0.009 | — | — | 0.0028 | — | 0.0039 | 0.471 | 0.204 |
| | | 34 | 0.012 | — | — | — | — | 0.0033 | 0.427 | 0.196 |
| | | 35 | — | — | — | — | — | 0.0028 | 0.477 | 0.222 |
| | compar- | 36 | 0.012 | — | — | — | — | 0.0022 | 0.254 | 0.114 |
| | ative steels | 37 | — | 0.007 | — | — | — | 0.0025 | 0.328 | 0.134 |

Ccq = 1/6 Mn + 1/24 Si + 1/40 Ni + 1/5 Cr + ¼ Mo + 1/14 V
Pcm = C + 1/30 Si + 1/20 Mn + 1/20 Cu + 1/60 Ni + 1/20 Cr + 1/15 Mo + 1/10 V + 5 B

TABLE 9

| Sorting of Steels | | Chemical Composition (% by weight) | | | | | | | | | | | |
|---|---|---|---|---|---|---|---|---|---|---|---|---|---|
| | | C | Si | Mn | P | S | Al | Mo | Nb | Ni | Cu | Cr | V |
| compar- | 38 | 0.045 | 0.31 | 0.84 | 0.013 | 0.002 | 0.026 | — | — | — | — | — | — |
| ative | 39 | 0.055 | 0.26 | 0.74 | 0.007 | 0.003 | 0.022 | 0.84 | 0.023 | — | — | — | — |
| steels | 40 | 0.057 | 0.25 | 0.73 | 0.005 | 0.004 | 0.025 | 0.15 | 0.020 | — | — | — | — |
| | 41 | 0.063 | 0.17 | 0.52 | 0.012 | 0.002 | 0.026 | 0.20 | 0.016 | — | — | — | — |
| | 42 | 0.067 | 0.16 | 0.54 | 0.006 | 0.004 | 0.023 | 0.95 | 0.016 | — | — | — | — |
| | 43 | 0.083 | 0.22 | 0.74 | 0.009 | 0.003 | 0.022 | 0.60 | — | 0.15 | 0.25 | 0.30 | — |
| | 44 | 0.087 | 0.24 | 0.77 | 0.012 | 0.002 | 0.024 | 0.32 | 0.015 | — | — | — | 0.042 |
| | 45 | 0.088 | 0.23 | 0.76 | 0.013 | 0.004 | 0.025 | — | 0.025 | — | — | 0.52 | — |
| | 46 | 0.106 | 0.26 | 0.68 | 0.007 | 0.003 | 0.027 | 0.25 | 0.022 | — | — | 0.35 | — |
| | 47 | 0.125 | 0.22 | 0.55 | 0.006 | 0.002 | 0.026 | 0.78 | — | — | — | — | — |
| | 48 | 0.145 | 0.16 | 0.54 | 0.007 | 0.003 | 0.023 | — | 0.030 | — | — | — | 0.034 |

| | Sorting of Steels | | Chemical Composition (% by weight) | | | | | | | |
|---|---|---|---|---|---|---|---|---|---|---|
| | | | Ti | Zr | B | Ca | REM | N | Ccq | Pcm |
| | compar- | 38 | 0.014 | — | — | 0.0033 | — | 0.0038 | 0.198 | 0.097 |
| | ative | 39 | — | 0.006 | — | — | — | 0.0018 | 0.399 | 0.157 |
| | steels | 40 | 0.012 | — | — | — | — | 0.0024 | 0.227 | 0.112 |
| | | 41 | — | — | — | 0.0038 | — | 0.0032 | 0.207 | 0.108 |
| | | 42 | 0.009 | — | — | — | — | 0.0022 | 0.401 | 0.163 |
| | | 43 | — | 0.007 | — | — | — | 0.0025 | 0.429 | 0.197 |
| | | 44 | — | — | — | — | — | 0.0016 | 0.308 | 0.159 |
| | | 45 | 0.011 | — | — | — | — | 0.0023 | 0.328 | 0.160 |
| | | 46 | — | 0.009 | — | — | — | 0.0034 | 0.363 | 0.183 |
| | | 47 | 0.013 | — | — | — | 0.0017 | 0.0036 | 0.421 | 0.212 |
| | | 48 | — | — | — | — | — | 0.0019 | 0.244 | 0.181 |

Ccq = 1/6 Mn + 1/24 Si + 1/40 Ni + 1/5 Cr + ¼ Mo + 1/14 V
Pcm = C + 1/30 Si + 1/20 Mn + 1/20 Cu + 1/60 Ni + 1/20 Cr + 1/15 Mo + 1/10 V + 5 B

TABLE 10

| | | | Heating, Rolling and Cooling Conditions | | | | | Normal Temperature Strength | | | High-Temperature Strength at 600° C. | | Ratio (%) of Strength at 600° C. to Normal Temperature Strength |
|---|---|---|---|---|---|---|---|---|---|---|---|---|---|
| Sorting | Steel No. | Preparation Process | slab-heating temperature (°C.) | finish rolling temperature (°C.) | cooling after rolling | Heat Treatment (°C.) | Plate Thickness (mm) | YS (kgf/mm²) | TS (kgf/mm²) | YR (%) | YS (kgf/mm²) | TS (kgf/mm²) | (600° C. YS/normal temperature YS) |
| pre- | 1 | as-rolled | 1200 | 840 | air-cooling | not effected | 30 | 24.7 | 45.7 | 54 | 18.3 | 29.5 | 74 |
| sent inven- | 2 | as-rolled | 1150 | 870 | air-cooling | not effected | 25 | 26.9 | 48.9 | 55 | 19.4 | 30.8 | 72 |
| tion | 3 | as-rolled | 1250 | 905 | air-cooling | not effected | 40 | 28.0 | 48.2 | 58 | 21.6 | 33.7 | 77 |
| | 4 | as-rolled | 1200 | 902 | air-cooling | not effected | 32 | 28.6 | 50.1 | 57 | 20.6 | 33.2 | 72 |
| | 5 | as- | 1100 | 868 | air- | not | 22 | 28.5 | 45.3 | 63 | 20.2 | 31.4 | 71 |

TABLE 10-continued

| Sorting | Steel No. | Preparation Process | Heating, Rolling and Cooling Conditions: slab-heating temperature (°C.) | finish rolling temperature (°C.) | cooling after rolling | Heat Treatment (°C.) | Plate Thickness (mm) | Normal Temperature Strength: YS (kgf/mm²) | TS (kgf/mm²) | YR (%) | High-Temperature Strength at 600° C.: YS (kgf/mm²) | TS (kgf/mm²) | Ratio (%) of Strength at 600° C. to Normal Temperature Strength (600° C. YS/normal temperature YS) |
|---|---|---|---|---|---|---|---|---|---|---|---|---|---|
| | | rolled | | | cooling | effected | | | | | | | |
| | 6 | as-rolled | 1200 | 917 | air-cooling | not effected | 45 | 24.2 | 45.6 | 53 | 17.4 | 28.3 | 72 |
| | 7 | as-rolled | 1150 | 872 | air-cooling | not effected | 30 | 27.8 | 44.9 | 62 | 19.7 | 31.3 | 71 |
| | 8 | as-rolled | 1250 | 913 | air-cooling | not effected | 50 | 22.2 | 42.6 | 52 | 16.9 | 26.5 | 76 |
| | 9 | as-rolled | 1200 | 910 | air-cooling | not effected | 20 | 24.3 | 43.0 | 57 | 17.7 | 27.8 | 73 |
| | 10 | as-rolled | 1200 | 918 | air-cooling | not effected | 36 | 29.2 | 44.9 | 65 | 21.0 | 33.4 | 72 |
| | 11 | as-rolled | 1150 | 854 | air-cooling | not effected | 25 | 33.6 | 49.2 | 68 | 26.5 | 41.1 | 79 |
| | 12 | as-rolled | 1250 | 922 | air-cooling | not effected | 32 | 30.6 | 46.3 | 66 | 23.3 | 37.2 | 76 |

TABLE 11

| Sorting | Steel No. | Preparation Process | Heating, Rolling and Cooling Conditions: slab-heating temperature (°C.) | finish rolling temperature (°C.) | cooling after rolling | Heat Treatment (°C.) | Plate Thickness (mm) | Normal Temperature Strength: YS (kgf/mm²) | TS (kgf/mm²) | YR (%) | High-Temperature Strength at 600° C.: YS (kgf/mm²) | TS (kgf/mm²) | Ratio (%) of Strength at 600° C. to Normal Temperature Strength (600° C. YS/normal temperature YS) |
|---|---|---|---|---|---|---|---|---|---|---|---|---|---|
| present invention | 13 | as-rolled | 1200 | 906 | air-cooling | not effected | 40 | 44.3 | 59.9 | 74 | 31.5 | 42.2 | 71 |
| | 14 | as-rolled | 1250 | 913 | air-cooling | not effected | 25 | 34.2 | 51.8 | 66 | 25.7 | 40.5 | 75 |
| | 15 | as-rolled | 1300 | 968 | air-cooling | not effected | 50 | 44.5 | 60.2 | 74 | 31.6 | 48.7 | 71 |
| | 16 | as-rolled | 1200 | 905 | air-cooling | not effected | 20 | 39.8 | 58.7 | 68 | 30.6 | 39.9 | 77 |
| | 17 | as-rolled | 1100 | 824 | air-cooling | not effected | 32 | 33.4 | 50.7 | 66 | 24.4 | 39.7 | 73 |
| | 18 | as-rolled | 1250 | 917 | air-cooling | not effected | 36 | 35.1 | 54.4 | 65 | 25.3 | 39.2 | 72 |
| | 19 | as-rolled | 1150 | 866 | air-cooling | not effected | 40 | 35.7 | 52.5 | 68 | 26.1 | 41.4 | 73 |
| | 20 | as-rolled | 1200 | 897 | air-cooling | not effected | 40 | 45.8 | 61.9 | 74 | 34.8 | 49.6 | 76 |
| | 21 | as-rolled | 1250 | 913 | air-cooling | not effected | 45 | 39.3 | 55.3 | 71 | 28.3 | 43.3 | 72 |
| | 22 | as-rolled | 1150 | 842 | air-cooling | not effected | 32 | 33.1 | 51.6 | 64 | 24.8 | 38.2 | 75 |
| | 23 | as-rolled | 1300 | 994 | air-cooling | not effected | 40 | 36.6 | 55.4 | 66 | 27.8 | 44.0 | 76 |
| | 24 | as-rolled | 1250 | 906 | air-cooling | not effected | 27 | 37.7 | 55.5 | 68 | 29.0 | 46.0 | 77 |

TABLE 12

| Sorting | Steel No. | Preparation Process | Heating, Rolling and Cooling Conditions: slab-heating temperature (°C.) | finish rolling temperature (°C.) | cooling after rolling | Heat Treatment (°C.) | Plate Thickness (mm) | Normal Temperature Strength: YS (kgf/mm²) | TS (kgf/mm²) | YR (%) | High-Temperature Strength at 600° C.: YS (kgf/mm²) | TS (kgf/mm²) | Ratio (%) of Strength at 600° C. to Normal Temperature Strength (600° C. YS/normal temperature YS) |
|---|---|---|---|---|---|---|---|---|---|---|---|---|---|
| present invention | 25 | as-rolled | 1100 | 832 | air-cooling | not effected | 25 | 42.3 | 57.2 | 74 | 32.1 | 50.1 | 76 |
| | 26 | as-rolled | 1200 | 874 | air-cooling | not effected | 35 | 46.2 | 61.3 | 75 | 34.7 | 54.3 | 75 |
| | 27 | as-rolled | 1250 | 914 | air-cooling | not effected | 25 | 48.4 | 65.4 | 74 | 34.8 | 54.8 | 72 |
| | 28 | as-rolled | 1200 | 866 | air-cooling | not effected | 20 | 47.3 | 63.1 | 75 | 35.9 | 57.0 | 76 |
| | 29 | as-rolled | 1200 | 882 | air-cooling | not effected | 45 | 44.5 | 59.3 | 75 | 33.8 | 52.3 | 76 |
| | 30 | as- | 1250 | 915 | air- | not | 36 | 46.0 | 62.2 | 74 | 34.5 | 53.8 | 75 |

TABLE 12-continued

| Sorting | Steel No. | Preparation Process | Heating, Rolling and Cooling Conditions: slab-heating temperature (°C.) | finish rolling temperature (°C.) | cooling after rolling | Heat Treatment (°C.) | Plate Thickness (mm) | Normal Temperature Strength: YS (kgf/mm²) | TS (kgf/mm²) | YR (%) | High-Temperature Strength at 600° C.: YS (kgf/mm²) | TS (kgf/mm²) | Ratio (%) of Strength at 600° C. to Normal Temperature Strength (600° C. YS/normal temperature YS) |
|---|---|---|---|---|---|---|---|---|---|---|---|---|---|
| | | rolled | | | cooling | effected | | | | | | | |
| | 31 | as-rolled | 1200 | 874 | air-cooling | not effected | 20 | 47.2 | 64.7 | 73 | 34.9 | 54.4 | 74 |
| | 32 | as-rolled | 1300 | 977 | air-cooling | not effected | 42 | 44.7 | 59.6 | 75 | 32.6 | 50.2 | 75 |
| | 33 | as-rolled | (1) 1250 | 926 | air-cooling | not effected | (2) 16 | 36.5 | 54.4 | 67 | 26.6 | 41.6 | (3) 73 |
| | 34 | as-rolled | (1) 1200 | 912 | air-cooling | not effected | (2) 22 | 38.9 | 54.0 | 72 | 27.6 | 42.5 | (3) 71 |
| | 35 | as-rolled | (1) 1150 | 937 | air-cooling | not effected | (2) 36 | 36.6 | 53.8 | 68 | 27.1 | 42.3 | (3) 74 |

Note
33, 34, 35: H-shaped steel
(1) heating temperature (°C.) of bloom, (2) web thickness (3) web strength

TABLE 13

| Sorting | Steel No. | Preparation Process | Heating, Rolling and Cooling Conditions: slab-heating temperature (°C.) | finish rolling temperature (°C.) | cooling after rolling | Heat Treatment (°C.) | Plate Thickness (mm) | Normal Temperature Strength: YS (kgf/mm²) | TS (kgf/mm²) | YR (%) | High-Temperature Strength at 600° C.: YS (kgf/mm²) | TS (kgf/mm²) | Ratio (%) of Strength at 600° C. to Normal Temperature Strength (600° C. YS/normal temperature YS) |
|---|---|---|---|---|---|---|---|---|---|---|---|---|---|
| comparison | 3 | as-rolled | 1050 | 766 | air-cooling | not effected | 40 | 39.8 | 49.7 | 80 | 15.9 | 21.4 | 40 |
| | 6 | as-rolled | 1150 | 736 | air-cooling | not effected | 45 | 37.8 | 46.1 | 82 | 15.5 | 27.6 | 41 |
| | 7 | direct quenching | 1200 | 904 | water-cooling | 580 × 20′ | 30 | 44.8 | 56.0 | 80 | 20.3 | 32.8 | 45 |
| | 11 | as-rolled | 1050 | 725 | air-cooling | not effected | 25 | 37.1 | 47.6 | 78 | 15.8 | 33.0 | 43 |
| | 13 | annealing | 1200 | 915 | air-cooling | 910 × 10′ AC | 40 | 30.3 | 50.2 | 60 | 14.2 | 36.5 | 47 |
| | 15 | quenching and tempering | 1150 | 824 | air-cooling | 910 WC 600° CAC | 50 | 44.4 | 54.6 | 82 | 16.2 | 33.6 | 36 |
| | 17 | as-rolled | 1000 | 730 | air-cooling | not effected | 32 | 40.0 | 51.9 | 77 | 15.7 | 32.6 | 39 |
| | 21 | annealing | 1150 | 806 | air-cooling | 910 × 10′AC | 45 | 32.1 | 51.4 | 62 | 11.9 | 41.3 | 37 |
| | 23 | direct quenching | 1100 | 872 | water cooling | 580 × 20′ AC | 40 | 51.1 | 63.4 | 81 | 19.9 | 45.2 | 39 |

TABLE 14

| Sorting | Steel No. | Preparation Process | Heating, Rolling and Cooling Conditions: slab-heating temperature (C.°) | finish rolling temperature (°C.) | cooling after rolling | Heat Treatment (°C.) | Plate Thickness (mm) | Normal Temperature Strength: YS (kgf/mm²) | TS (kgf/mm²) | YR (%) | High Temperature Strength at 600° C.: YS (kgf/mm²) | TS (kgf/mm²) | Ratio (%) of Strength at 600° C. to Normal Temperature Strength (600° C. YS/normal temperature YS) |
|---|---|---|---|---|---|---|---|---|---|---|---|---|---|
| comparison | 25 | annealing | 1050 | 727 | air-cooling | 910 × 10′ AC | 25 | 37.2 | 58.1 | 64 | 20.2 | 47.6 | 54 |
| | 28 | as-rolled | 1050 | 709 | air-cooling | not effected | 20 | 52.6 | 64.2 | 82 | 21.6 | 55.8 | 41 |
| | 30 | quenching and tempering | 1150 | 823 | air-cooling | 910 × 10′ WC 600 × 10′ AC | 36 | 57.9 | 67.3 | 86 | 23.2 | 55.2 | 40 |
| | 32 | as-rolled | 1000 | 736 | air-cooling | not effected | 42 | 49.3 | 62.4 | 79 | 28.1 | 49.6 | 57 |
| | 36 | as-rolled | 1200 | 912 | air-cooling | | 30 | 26.8 | 44.7 | 60 | 15.2 | 24.3 | 57 |
| | 37 | as-rolled | 1150 | 825 | air-cooling | | 30 | 26.9 | 46.4 | 58 | 13.4 | 21.5 | 50 |

TABLE 14-continued

| Sorting | Steel No. | Preparation Process | Heating, Rolling and Cooling Conditions: slab-heating temperature (C.°) | finish rolling temperature (°C.) | cooling after rolling | Heat Treatment (°C.) | Plate Thickness (mm) | Normal Temperature Strength: YS (kgf/mm²) | TS (kgf/mm²) | YR (%) | High Temperature Strength at 600° C.: YS (kgf/mm²) | TS (kgf/mm²) | Ratio (%) of Strength at 600° C. to Normal Temperature Strength (600° C. YS/normal temperature YS) |
|---|---|---|---|---|---|---|---|---|---|---|---|---|---|
| | 38 | as-rolled | 1250 | 914 | air-cooling | | 40 | 22.2 | 40.3 | 55 | 9.7 | 13.6 | 44 |
| | 39 | as-rolled | 1200 | 915 | air-cooling | | 35 | 32.0 | 53.4 | 60 | 24.3 | 39.4 | 76 |
| | 40 | as-rolled | 1250 | 917 | air-cooling | | 25 | 29.2 | 47.9 | 61 | 16.4 | 24.8 | 56 |
| | 41 | as-rolled | 1150 | 831 | air-cooling | | 20 | 24.9 | 42.9 | 58 | 16.2 | 25.5 | 65 |

TABLE 15

| Sorting | Steel No. | Preparation Process | Heating, Rolling and Cooling Conditions: slab-heating temperature (C.°) | finish rolling temperature (°C.) | cooling after rolling | Heat Treatment (°C.) | Plate Thickness (mm) | Normal Temperature Strength: YS (kgf/mm²) | TS (kgf/mm²) | YR (%) | High Temperature Strength at 600° C.: YS (kgf/mm²) | TS (kgf/mm²) | Ratio (%) of Strength at 600° C. to Normal Temperature Strength (600° C. YS/normal temperature YS) |
|---|---|---|---|---|---|---|---|---|---|---|---|---|---|
| comparison | 42 | as-rolled | 1200 | 903 | air-cooling | not effected | 37 | 32.4 | 53.1 | 61 | 24.9 | 39.6 | 77 |
| | 43 | as-rolled | 1250 | 928 | air-cooling | not effected | 32 | 28.0 | 49.2 | 57 | 18.5 | 29.3 | 66 |
| | 44 | as-rolled | 1150 | 806 | air-cooling | not effected | 30 | 40.3 | 53.0 | 76 | 21.8 | 34.4 | 54 |
| | 45 | as-rolled | 1200 | 864 | air-cooling | not effected | 40 | 35.7 | 49.6 | 72 | 18.6 | 30.4 | 52 |
| | 46 | as-rolled | 1150 | 821 | air-cooling | not effected | 25 | 38.9 | 52.6 | 74 | 21.0 | 33.9 | 54 |
| | 47 | as-rolled | 1250 | 896 | air-cooling | not effected | 25 | 32.7 | 51.9 | 63 | 21.6 | 34.3 | 66 |
| | 48 | as-rolled | 1200 | 850 | air-cooling | not effected | 32 | 36.7 | 50.3 | 73 | 20.9 | 33.5 | 57 |

EXAMPLE 2

Steel plates (having a thickness of 15 to 75 mm) differing in steel composition were manufactured by the process using an LD converter, continuous casting and plate rolling, and the normal temperature strength, high-temperature strength and the like were examined. The steel compositions of the present invention and comparative steels are shown in Tables 14 and 15, and the mechanical properties of the steels of the present invention and the comparative steels according to the heating, rolling and cooling conditions are shown in Tables 16 through 18. As shown in Tables 16 and 17, all of samples Nos. 46 through 75 of the present invention had an appropriate normal temperature strength and a good high-temperature strength. In contrast, in comparative sample No. 49, since the water cooling-starting temperature after rolling was higher than the $Ar_3$ temperature, the normal temperature strength was high, and the requirement of the ratio of yield strength of 600° C. for a normal temperature of more than about ⅔ (hereinafter referred to as "strength ratio requirement") strength (70%) was not satisfied. In comparative sample No. 51, since the heating temperature was low and the rolling temperature was low, the normal temperature strength was increased, and the 600° C. strength ratio requirement was not satisfied. In comparative sample No. 53, since the rolling was carried out at a temperature lower than 800° C., the normal temperature strength was high but the strength at 600° C. was low, and the strength ratio requirement was not satisfied. In comparative sample No. 54, since the water cooling-starting temperature was high as in comparative sample No. 49, the strength ratio requirement was not satisfied. In sample No. 55 where the quenched and tempered process was adopted, the strength ratio requirement was not satisfied. In comparative sample No. 58 where the as-rolled steel was used as in comparative example No. 53, the strength ratio requirement was not satisfied. In comparative sample No. 61, although the water cooling-starting temperature was lower than $Ar_3$, since this temperature was higher than the range specified in the present invention, the strength ratio requirement was not satisfied. In comparative sample No. 62, the strength ratio requirement was not satisfied for the same reason as in comparative sample No. 51. In comparative sample No. 64, since the water cooling-starting temperature was too low, the strength ratio requirement was not satisfied, and in comparative sample No. 65 since the heating temperature was too low, the strength ratio requirement was not satisfied. In comparative samples Nos. 76 through 85, the strength ratio requirement was not satisfied because the chemical composition was outside the range specified in the present invention. Namely, the strength ratio requirement was not satisfied because the Mo content was too low in comparative sample No. 76, the Mn content was too low in comparative sample No. 77, Mo was not added in comparative No. 78, the Mo content was too high and the water cooling-starting temperature was too high in comparative sample No. 79 and the Mo content was too low in comparative samples Nos. 80 through 85.

TABLE 16

| Sorting of Steels | | Chemical Composition (% by weight) | | | | | | | | | | | |
|---|---|---|---|---|---|---|---|---|---|---|---|---|---|
| | | C | Si | Mn | P | S | Al | Mo | Nb | Ni | Cu | Cr | V |
| present invention | 46 | 0.042 | 0.24 | 1.22 | 0.012 | 0.004 | 0.022 | 0.54 | — | — | — | — | — |
| | 47 | 0.052 | 0.33 | 0.96 | 0.016 | 0.006 | 0.021 | 0.62 | — | — | — | — | — |
| | 48 | 0.053 | 0.27 | 1.32 | 0.008 | 0.002 | 0.018 | 0.48 | — | — | — | — | — |
| | 49 | 0.055 | 0.53 | 1.03 | 0.015 | 0.002 | 0.027 | 0.53 | — | — | — | — | — |
| | 50 | 0.056 | 0.24 | 0.94 | 0.007 | 0.004 | 0.032 | 0.45 | — | — | — | — | — |
| | 51 | 0.049 | 0.26 | 1.19 | 0.009 | 0.003 | 0.022 | 0.53 | — | — | — | — | — |
| | 52 | 0.053 | 0.25 | 1.36 | 0.006 | 0.005 | 0.023 | 0.52 | — | — | — | — | — |
| | 53 | 0.064 | 0.23 | 0.85 | 0.013 | 0.003 | 0.026 | 0.55 | — | — | — | — | — |
| | 54 | 0.065 | 0.33 | 1.15 | 0.014 | 0.004 | 0.031 | 0.52 | — | — | — | — | — |
| | 55 | 0.072 | 0.17 | 0.91 | 0.011 | 0.004 | 0.024 | 0.54 | — | 0.15 | 0.22 | — | 0.035 |
| | 56 | 0.075 | 0.24 | 1.20 | 0.017 | 0.003 | 0.027 | 0.43 | — | — | — | 0.33 | — |
| | 57 | 0.073 | 0.28 | 1.35 | 0.009 | 0.005 | 0.033 | 0.40 | 0.024 | — | — | — | 0.041 |

| Sorting of Steels | | Chemical Composition (% by weight) | | | | | | | | $Ar_3$ |
|---|---|---|---|---|---|---|---|---|---|---|
| | | Ti | Zr | B | Ca | REM | N | Ccq | Pcm | (°C.) |
| present invention | 46 | 0.011 | — | — | — | — | 0.0031 | 0.390 | 0.147 | 786 |
| | 47 | — | 0.006 | — | — | — | 0.0025 | 0.381 | 0.152 | 799 |
| | 48 | 0.013 | — | — | 0.0025 | — | 0.0036 | 0.404 | 0.160 | 776 |
| | 49 | 0.012 | — | — | — | 0.0015 | 0.0033 | 0.381 | 0.160 | 799 |
| | 50 | 0.007 | — | 0.0006 | — | — | 0.0020 | 0.335 | 0.144 | 797 |
| | 51 | — | 0.015 | — | — | — | 0.0026 | 0.416 | 0.159 | 785 |
| | 52 | 0.008 | — | — | — | 0.0020 | 0.0031 | 0.420 | 0.164 | 773 |
| | 53 | 0.021 | — | — | 0.0048 | — | 0.0037 | 0.352 | 0.151 | 798 |
| | 54 | — | 0.006 | — | — | — | 0.0025 | 0.400 | 0.168 | 783 |
| | 55 | 0.011 | — | — | 0.0023 | — | 0.0032 | 0.372 | 0.176 | 782 |
| | 56 | 0.076 | — | — | — | — | 0.0018 | 0.459 | 0.188 | 774 |
| | 57 | — | 0.006 | — | — | — | 0.0023 | 0.413 | 0.181 | 779 |

Ccq = C + 1/6 Mn + 1/24 Si + 1/40 Ni + 1/5 Cr + ¼ Mo + 1/14 V
Pcm = C + 1/30 Si + 1/20 Mn + 1/20 Cu + 1/60 Ni + 1/20 Cr + 1/15 Mo + 1/10 V + 5 B

TABLE 17

| Sorting of Steels | | Chemical Composition (% by weight) | | | | | | | | | | |
|---|---|---|---|---|---|---|---|---|---|---|---|---|
| | | C | Si | Mn | P | S | Al | Mo | Nb | Ni | Cu | Cr |
| present invention | 58 | 0.082 | 0.32 | 1.45 | 0.007 | 0.004 | 0.029 | 0.44 | — | — | — | 0.55 |
| | 59 | 0.085 | 0.24 | 1.05 | 0.013 | 0.002 | 0.022 | 0.58 | 0.016 | 0.24 | 0.15 | — |
| | 60 | 0.081 | 0.33 | 1.55 | 0.007 | 0.003 | 0.026 | 0.53 | 0.021 | — | — | — |
| | 61 | 0.093 | 0.21 | 1.48 | 0.005 | 0.006 | 0.019 | 0.31 | 0.015 | — | — | — |
| | 62 | 0.087 | 0.14 | 1.17 | 0.009 | 0.002 | 0.023 | 0.52 | 0.020 | — | — | — |
| | 63 | 0.095 | 0.32 | 1.10 | 0.008 | 0.003 | 0.024 | 0.53 | 0.032 | — | — | — |
| | 64 | 0.093 | 0.26 | 1.23 | 0.007 | 0.004 | 0.031 | 0.50 | 0.011 | 0.10 | 0.035 | 0.22 |
| | 65 | 0.088 | 0.24 | 1.35 | 0.013 | 0.003 | 0.024 | 0.27 | 0.010 | — | — | 0.53 |
| | 66 | 0.096 | 0.25 | 1.05 | 0.005 | 0.002 | 0.023 | 0.35 | 0.025 | 0.31 | 0.36 | 0.48 |
| | 67 | 0.103 | 0.23 | 0.84 | 0.007 | 0.003 | 0.025 | 0.67 | — | — | — | 0.25 |
| | 68 | 0.105 | 0.22 | 1.55 | 0.006 | 0.004 | 0.027 | 0.23 | 0.033 | — | — | 0.15 |
| | 69 | 0.106 | 0.17 | 0.63 | 0.013 | 0.004 | 0.025 | 0.35 | 0.021 | — | — | 0.65 |

| Sorting of Steels | | Chemical Composition (% by weight) | | | | | | | | | $Ar_3$ |
|---|---|---|---|---|---|---|---|---|---|---|---|
| | | V | Ti | Zr | B | Ca | REM | N | Ccq | Pcm | (°C.) |
| present invention | 58 | — | 0.012 | — | — | — | — | 0.0015 | 0.557 | 0.222 | 758 |
| | 59 | — | — | — | — | — | — | 0.0024 | 0.421 | 0.196 | 764 |
| | 60 | 0.018 | — | 0.009 | — | — | — | 0.0034 | 0.487 | 0.207 | 760 |
| | 61 | — | 0.094 | — | — | — | — | 0.0032 | 0.426 | 0.195 | 752 |
| | 62 | 0.032 | — | — | — | — | — | 0.0026 | 0.420 | 0.188 | 778 |
| | 63 | — | — | — | — | — | — | 0.0020 | 0.424 | 0.196 | 780 |
| | 64 | — | 0.012 | — | — | 0.0027 | — | 0.0035 | 0.480 | 0.227 | 750 |
| | 65 | 0.062 | — | 0.007 | — | — | — | 0.0027 | 0.501 | 0.214 | 773 |
| | 66 | — | 0.008 | — | — | 0.0037 | — | 0.0033 | 0.473 | 0.227 | 751 |
| | 67 | — | 0.013 | — | — | — | 0.0020 | 0.0035 | 0.470 | 0.210 | 784 |
| | 68 | — | 0.010 | — | — | — | — | 0.0024 | 0.460 | 0.213 | 747 |
| | 69 | — | 0.008 | — | — | — | — | 0.0032 | 0.436 | 0.199 | 779 |

Ccq = C + 1/6 Mn + 1/24 Si + 1/40 Ni + 1/5 Cr + ¼ Mo + 1/14 V
Pcm = C + 1/30 Si + 1/20 Mn + 1/20 Cu + 1/60 Ni + 1/20 Cr + 1/15 Mo + 1/10 V + 5 B

TABLE 18

| Sorting of | Chemical Composition (% by weight) |
|---|---|

TABLE 18-continued

| Steels | | C | Si | Mn | P | S | Al | Mo | Nb | Ni | Cu | Cr | V |
|---|---|---|---|---|---|---|---|---|---|---|---|---|---|
| pre- | 70 | 0.108 | 0.20 | 0.76 | 0.006 | 0.003 | 0.022 | 0.42 | 0.012 | 0.15 | 0.76 | — | — |
| sent | 71 | 0.107 | 0.24 | 0.75 | 0.008 | 0.004 | 0.026 | 0.40 | 0.020 | 0.24 | 0.65 | 0.25 | — |
| inven- | 72 | 0.112 | 0.23 | 1.21 | 0.007 | 0.002 | 0.022 | 0.52 | — | — | — | 0.35 | — |
| tion | 73 | 0.113 | 0.15 | 1.16 | 0.004 | 0.003 | 0.003 | 0.43 | 0.015 | — | — | — | 0.030 |
| | 74 | 0.116 | 0.07 | 1.35 | 0.006 | 0.004 | 0.003 | 0.48 | 0.017 | — | — | — | — |
| | 75 | 0.117 | 0.36 | 0.55 | 0.005 | 0.006 | 0.032 | 0.45 | 0.009 | 0.35 | 0.30 | 0.35 | — |
| com- | 76 | 0.057 | 0.27 | 1.05 | 0.004 | 0.002 | 0.025 | 0.17 | 0.036 | — | — | — | 0.045 |
| pari- | 77 | 0.066 | 0.37 | 0.35 | 0.009 | 0.003 | 0.022 | 0.43 | — | — | — | 0.25 | — |
| son | 78 | 0.073 | 0.31 | 1.56 | 0.013 | 0.004 | 0.031 | — | 0.024 | — | — | — | 0.037 |
| | 79 | 0.082 | 0.24 | 0.95 | 0.008 | 0.003 | 0.023 | 0.89 | 0.015 | — | — | — | — |
| | 80 | 0.095 | 0.34 | 1.20 | 0.006 | 0.002 | 0.026 | 0.17 | 0.020 | 0.42 | 0.50 | 0.51 | — |
| | 81 | 0.103 | 0.26 | 1.05 | 0.007 | 0.005 | 0.046 | 0.15 | — | 0.15 | 0.13 | 0.75 | — |
| | 82 | 0.105 | 0.25 | 1.40 | 0.006 | 0.003 | 0.019 | 0.08 | 0.032 | 0.35 | 0.35 | — | 0.044 |

| Sorting of Steels | | Chemical Composition (% by weight) Ti | Zr | B | Ca | REM | N | Ccq | Pcm | $Ar_3$ (°C.) |
|---|---|---|---|---|---|---|---|---|---|---|
| pre- | 70 | 0.007 | — | — | — | — | 0.0021 | 0.352 | 0.221 | 754 |
| sent | 71 | 0.013 | — | — | — | — | 0.0036 | 0.398 | 0.228 | 757 |
| inven- | 72 | — | — | — | — | — | 0.0031 | 0.523 | 0.232 | 758 |
| tion | 73 | 0.015 | — | — | — | — | 0.0023 | 0.422 | 0.208 | 767 |
| | 74 | 0.017 | — | — | — | — | 0.0025 | 0.464 | 0.218 | 748 |
| | 75 | 0.008 | — | — | — | — | 0.0017 | 0.415 | 0.225 | 772 |
| com- | 76 | — | — | — | — | — | 0.0028 | 0.289 | 0.134 | 806 |
| pari- | 77 | 0.010 | — | — | — | — | 0.0030 | 0.297 | 0.137 | 830 |
| son | 78 | 0.008 | — | — | — | — | 0.0026 | 0.349 | 0.165 | 767 |
| | 79 | 0.007 | — | — | — | — | 0.0033 | 0.473 | 0.197 | 789 |
| | 80 | — | — | — | 0.0026 | — | 0.0037 | 0.464 | 0.235 | 734 |
| | 81 | — | — | 0.0010 | — | — | 0.0023 | 0.480 | 0.226 | 768 |
| | 82 | — | — | — | — | — | 0.0016 | 0.381 | 0.216 | 735 |

Ccq = C + 1/6 Mn + 1/24 Si + 1/40 Ni + 1/5 Cr + ¼ Mo + 1/14 V
Pcm = C + 1/30 Si + 1/20 Mn + 1/20 Cu + 1/60 Ni + 1/20 Cr + 1/15 Mo + 1/10 V + 5 B

TABLE 19

| Sorting of Steels | | Chemical Composition (% by weight) C | Si | Mn | P | S | Al | Mo | Nb | Ni | Cu | Cr |
|---|---|---|---|---|---|---|---|---|---|---|---|---|
| com- | 83 | 0.109 | 0.28 | 0.58 | 0.014 | 0.004 | 0.022 | — | 0.023 | 0.53 | 0.55 | 0.65 |
| pari- | 84 | 0.115 | 0.22 | 1.36 | 0.011 | 0.002 | 0.024 | 0.09 | — | — | — | — |
| son | 85 | 0.117 | 0.28 | 1.45 | 0.009 | 0.003 | 0.025 | — | — | — | — | 1.15 |

| Sorting of Steels | | Chemical Composition (% by weight) V | Ti | Zr | B | Ca | REM | N | Ccq | Pcm | $Ar_3$ (°C.) |
|---|---|---|---|---|---|---|---|---|---|---|---|
| com- | 83 | 0.035 | — | — | — | — | — | 0.0043 | 0.363 | 0.220 | 763 |
| pari- | 84 | — | 0.012 | — | — | — | 0.0015 | 0.0032 | 0.373 | 0.196 | 748 |
| son | 85 | 0.032 | — | — | — | — | — | 0.0031 | 0.603 | 0.260 | 750 |

Ccq = C + 1/6 Mn + 1/24 Si + 1/40 Ni + 1/5 Cr + ¼ Mo + 1/14 V
Pcm = C + 1/30 Si + 1/20 Mn + 1/20 Cu + 1/60 Ni + 1/20 Cr + 1/15 Mo + 1/10 V + 5 B

TABLE 20

| | | Heating, Rolling and ature | | | | | Conditions | | | | | | | |
|---|---|---|---|---|---|---|---|---|---|---|---|---|---|---|
| | | | | | | | | | Normal Temperature Strength | | | Strength at 600° C. | | Ratio (%) of Strength at 600° C. to Normal Temperature |
| Sorting | Steel No. | slab-heating pem-per-erature (C.°) | finish rill-ing pem-per-ature (°C.) | water cooling-initiating temper-ature (°C.) | cooling rate (°C./sec) | cooling stop-ping tem-per-ature (°C.) | Heat Treat-ment | Plate Thick-ness (mm) | YS (kgf/mm²) | TS (kgf/mm²) | YR (%) | YS (kgf/mm²) | TS (kgf/mm²) | Strength (600° C. YS/normal temperature YS) |
| pre- | 46 | 1150 | 836 | 760 | 27 | 454 | — | 25 | 37.9 | 59.1 | 66 | 27.7 | 40.4 | 71 |
| sent | 47 | 1150 | 825 | 765 | 27 | 453 | — | 25 | 37.3 | 55.7 | 67 | 27.6 | 41.6 | 74 |
| in- | 48 | 1200 | 873 | 730 | 16 | 370 | — | 40 | 36.9 | 51.3 | 72 | 25.8 | 39.0 | 70 |
| ven- | 49 | 1100 | 818 | 770 | 23 | cooled to room tem-per-ature | 500° C. Tem-per | 30 | 37.4 | 50.5 | 74 | 26.2 | 39.1 | 70 |
| tion | 50 | 1200 | 882 | 770 | 26 | cooled to room tem-per-ature | 500° C. Tem-per | 30 | 37.2 | 54.7 | 68 | 26.8 | 39.9 | 72 |

TABLE 20-continued

| Sorting | Steel No. | Heating, Rolling and ature: slab-heating pem-per-erature (C.°) | finish rill-ing pem-per-ature (°C.) | water cooling-initiating temper-ature (°C.) | cooling rate (°C./sec) | cooling stop-ping tem-per-ature (°C.) | Heat Treatment | Plate Thickness (mm) | Conditions: Normal Temperature Strength YS (kgf/mm²) | TS (kgf/mm²) | YR (%) | Strength at 600° C. YS (kgf/mm²) | TS (kgf/mm²) | Ratio (%) of Strength at 600° C. to Normal Temperature Strength (600° C. YS/normal temperature YS) |
|---|---|---|---|---|---|---|---|---|---|---|---|---|---|---|
| | 51 | 1250 | 922 | 750 | 35 | 523 | — | 15 | 42.8 | 58.6 | 73 | 29.9 | 40.6 | 70 |
| | 52 | 1150 | 812 | 755 | 35 | 476 | — | 15 | 43.3 | 57.7 | 75 | 30.7 | 39.8 | 71 |
| | 53 | 1200 | 884 | 780 | 16 | 425 | — | 40 | 37.1 | 57.1 | 65 | 26.7 | 40.3 | 70 |
| | 54 | 1150 | 827 | 765 | 16 | 438 | — | 40 | 37.2 | 54.7 | 68 | 26.4 | 38.7 | 71 |
| | 55 | 1100 | 809 | 740 | 19 | 452 | — | 35 | 39.8 | 59.4 | 67 | 29.1 | 40.9 | 73 |

TABLE 21

| Sorting | Steel No. | Heating, Rolling and Cooling Conditions: slab-heating tem-per-ature (C.°) | finish roll-ing tem-per-ature (°C.) | water cooling-initiating temper-ature (°C.) | cooling rate (°C./sec) | cooling stop-ping tem-temp-ature (°C.) | Heat Treatment | Plate Thickness (mm) | Normal Temperature Strength YS (kgf/mm²) | TS (kgf/mm²) | YR (%) | Strength at 600° C. YS (kgf/mm²) | TS (kgf/mm²) | Ratio (%) of Strength at 600° C. to Normal Temperature Strength (600° C. YS/normal temperature YS) |
|---|---|---|---|---|---|---|---|---|---|---|---|---|---|---|
| pre- | 56 | 1150 | 842 | 740 | 30 | 413 | — | 25 | 39.2 | 52.3 | 75 | 29.0 | 42.1 | 74 |
| sent | 57 | 1200 | 856 | 735 | 19 | 537 | — | 30 | 42.2 | 57.0 | 74 | 30.4 | 43.0 | 72 |
| in- | 58 | 1150 | 836 | 720 | 26 | 435 | — | 30 | 44.9 | 69.1 | 65 | 31.4 | 43.4 | 70 |
| ven- | 59 | 1300 | 922 | 705 | 35 | 458 | — | 20 | 42.4 | 58.8 | 72 | 31.0 | 44.7 | 73 |
| tion | 60 | 1200 | 867 | 725 | 35 | cooled to room tem-per-ature | 450° C. Tem-per | 20 | 48.9 | 65.2 | 75 | 36.2 | 45.3 | 74 |
| | 61 | 1150 | 816 | 720 | 25 | cooled to room tem-per-ature | 450° C. Tem-per | 25 | 42.3 | 57.9 | 73 | 29.6 | 39.0 | 70 |
| | 62 | 1200 | 838 | 745 | 25 | 386 | — | 25 | 42.7 | 60.1 | 71 | 30.7 | 41.9 | 72 |
| | 63 | 1250 | 927 | 725 | 26 | 455 | — | 30 | 44.2 | 59.7 | 74 | 32.3 | 40.9 | 73 |
| | 64 | 1200 | 855 | 700 | 26 | 462 | — | 30 | 50.6 | 73.3 | 69 | 35.4 | 47.6 | 70 |
| | 65 | 1150 | 851 | 735 | 8.5 | 447 | — | 50 | 48.3 | 67.1 | 72 | 34.3 | 46.5 | 71 |

TABLE 22

| Sorting | Steel No. | Heating, Rolling and Cooling Conditions: slab-heating tem-per-ature (C.°) | finish roll-ing tem-per-ature (°C.) | water cooling-initiating temper-ature (°C.) | cooling rate (°C./sec) | cooling stop-ping tem-per-ature (°C.) | Heat Treatment | Plate Thickness (mm) | Normal Temperature Strength YS (kgf/mm²) | TS (kgf/mm²) | YR (%) | Strength at 600° C. YS (kgf/mm²) | TS (kgf/mm²) | Ratio (%) of Strength at 600° C. to Normal Temperature Strength (600° C. YS/normal temperature YS) |
|---|---|---|---|---|---|---|---|---|---|---|---|---|---|---|
| pre- | 66 | 1200 | 947 | 710 | 5.8 | 462 | — | 75 | 49.3 | 65.7 | 75 | 34.5 | 46.8 | 70 |
| sent | 67 | 1100 | 829 | 735 | 30 | 404 | — | 25 | 49.2 | 68.3 | 72 | 36.4 | 47.3 | 74 |
| in- | 68 | 1200 | 876 | 700 | 30 | 488 | — | 25 | 49.3 | 65.7 | 75 | 34.5 | 45.8 | 70 |
| ven- | 69 | 1150 | 833 | 730 | 16 | 495 | — | 40 | 47.5 | 66.9 | 71 | 33.3 | 44.6 | 70 |
| tion | 70 | 1100 | 802 | 695 | 30 | 367 | — | 25 | 43.6 | 65.1 | 67 | 32.7 | 44.3 | 75 |
| | 71 | 1150 | 860 | 690 | 19 | 396 | — | 30 | 43.3 | 62.8 | 69 | 32.0 | 44.2 | 74 |
| | 72 | 1100 | 813 | 705 | 19 | 425 | — | 35 | 50.2 | 67.8 | 74 | 35.6 | 47.1 | 71 |
| | 73 | 1150 | 802 | 695 | 35 | 453 | — | 20 | 48.7 | 66.7 | 73 | 34.1 | 44.7 | 70 |
| | 74 | 1200 | 840 | 705 | 30 | 416 | — | 25 | 50.7 | 68.5 | 74 | 36.5 | 46.8 | 72 |
| | 75 | 1150 | 832 | 725 | 19 | 445 | — | 30 | 43.8 | 63.4 | 69 | 31.5 | 42.8 | 72 |

TABLE 23

| Sorting | Steel No. | Heating, Rolling and Cooling Conditions: slab-heating temperature (C.°) | finish rolling temperature (°C.) | water cooling-initiating temperature (°C.) | cooling rate (°C./sec) | cooling stopping temperature (°C.) | Heat Treatment | Plate Thickness (mm) | Normal Temperature Strength: YS (kgf/mm²) | TS (kgf/mm²) | YR (%) | Strength at 600° C.: YS (kgf/mm²) | TS (kgf/mm²) | Ratio (%) of Strength at 600° C. to Normal Temperature Strength (600° C. YS/normal temperature YS) |
|---|---|---|---|---|---|---|---|---|---|---|---|---|---|---|
| comparison | 49 | 1100 | 825 | 800 | 23 | 432 | — | 30 | 44.7 | 57.3 | 78 | 28.2 | 37.5 | 63 |
| | 51 | 1000 | 765 | 760 | 30 | 463 | — | 25 | 46.7 | 59.1 | 79 | 29.0 | 38.8 | 62 |
| | 53 | 1150 | 755 | — | — | — | — | 30 | 38.5 | 48.7 | 79 | 25.4 | 37.4 | 66 |
| | 54 | 1250 | 958 | 810 | 30 | cooled to room temperature | 500° C. Temper | 25 | 42.6 | 52.0 | 82 | 27.3 | 37.9 | 64 |
| | 55 | 1200 | 860 | — | — | — | 910° CWC 600° C. Temper | 20 | 37.8 | 52.1 | 73 | 24.9 | 37.5 | 66 |
| | 58 | 1150 | 745 | — | — | — | — | 30 | 42.7 | 56.3 | 76 | 26.9 | 38.5 | 63 |
| | 61 | 1200 | 865 | 770 | 30 | 514 | — | 25 | 46.2 | 57.8 | 80 | 28.1 | 39.3 | 61 |
| | 62 | 1050 | 742 | — | — | — | — | 25 | 40.6 | 50.1 | 81 | 26.8 | 36.9 | 66 |

TABLE 24

| Sorting | Steel No. | Heating, Rolling and Cooling Conditions: slab-heating temperature (C.°) | finish rolling temperature (°C.) | water cooling-initiating temperature (°C.) | cooling rate (°C./sec) | cooling stopping temperature (°C.) | Heat Treatment | Plate Thickness (mm) | Normal Temperature Strength: YS (kgf/mm²) | TS (kgf/mm²) | YR (%) | Strength at 600° C.: YS (kgf/mm²) | TS (kgf/mm²) | Ratio (%) of Strength at 600° C. to Normal Temperature Strength (600° C. YS/normal temperature YS) |
|---|---|---|---|---|---|---|---|---|---|---|---|---|---|---|
| comparison | 64 | 1200 | 856 | 645 | 23 | 453 | — | 30 | 34.9 | 51.3 | 68 | 24.1 | 39.6 | 69 |
| | 65 | 1050 | 785 | 770 | 23 | 385 | — | 30 | 52.6 | 66.5 | 79 | 34.7 | 47.1 | 66 |
| | 76 | 1200 | 863 | 750 | 23 | 526 | — | 30 | 28.3 | 43.5 | 65 | 17.0 | 30.2 | 60 |
| | 77 | 1150 | 826 | 765 | 16 | 462 | — | 40 | 29.4 | 47.4 | 62 | 18.8 | 32.4 | 64 |
| | 78 | 1150 | 814 | 740 | 23 | 447 | — | 30 | 37.4 | 51.2 | 73 | 20.2 | 33.3 | 54 |
| | 79 | 1200 | 855 | 775 | 25 | 460 | — | 25 | 43.6 | 56.6 | 77 | 30.1 | 42.7 | 69 |
| | 80 | 1200 | 876 | 700 | 23 | 447 | — | 30 | 45.7 | 58.6 | 78 | 29.7 | 40.6 | 65 |
| | 81 | 1100 | 807 | 710 | 25 | 511 | — | 25 | 47.3 | 63.9 | 74 | 29.8 | 42.4 | 63 |
| | 82 | 1250 | 934 | 715 | 23 | 428 | — | 30 | 48.9 | 63.5 | 77 | 30.3 | 42.4 | 62 |

TABLE 25

| Sorting | Steel No. | Heating, Rolling and Cooling Conditions: slab-heating temperature (C.°) | finish rolling temperature (°C.) | water cooling-initiating temperature (°C.) | cooling rate (°C./sec) | cooling stopping temperature (°C.) | Heat Treatment | Plate Thickness (mm) | Normal Temperature Strength: YS (kgf/mm²) | TS (kgf/mm²) | YR (%) | Strength at 600° C.: YS (kgf/mm²) | TS (kgf/mm²) | Ratio (%) of Strength at 600° C. to Normal Temperature Strength (600° C. YS/normal temperature YS) |
|---|---|---|---|---|---|---|---|---|---|---|---|---|---|---|
| comparison | 83 | 1150 | 820 | 695 | 25 | 516 | — | 25 | 49.6 | 65.3 | 76 | 28.8 | 43.0 | 58 |
| | 84 | 1100 | 807 | 700 | 23 | 387 | — | 30 | 47.7 | 61.2 | 78 | 26.7 | 40.8 | 56 |
| | 85 | 1200 | 873 | 715 | 25 | 354 | — | 25 | 50.3 | 69.9 | 72 | 24.6 | 44.5 | 49 |

We claim:

1. A process for manufacturing a building construction steel having an excellent fire resistance and a low yield ratio, which comprises heating a slab, billet or bloom consisting of 0.04 to 0.15% by weight of C, up to 0.6% by weight of Si, 0.5 to 1.6% by weight of Mn, 0.005 to 0.04% by weight of Nb, 0.4 to 0.7% by weight of Mo, up to 0.1% by weight of Al and 0.001 to 0.006% by weight of N, with the balance being Fe and unavoidable impurities, at a temperature in the range of from 1100° to 1300° C. and hot rolling with a finishing temperature of from 800° to 1000° C. and naturally cooling to room temperature.

2. A process for manufacturing building construction steel having an excellent fire resistance and a low yield ratio, which comprises heating a slab, billet or bloom consisting of 0.04 to 0.15% by weight of C, up to 0.6% by weight of Si, 0.5 to 1.6% by weight of Mn, 0.005 to 0.04% by weight of Nb, 0.4 to 0.7% by weight of Mo, up to 0.1% by weight of Al, 0.001 to 0.006% by weight of N, and at least one member selected from the group consisting of 0.005 to 0.10% by weight of Ti, 0.005 to 0.03% by weight of Zr, 0.005 to 0.10% by weight of V, 0.05 to 0.5% by weight of Ni, 0.05 to 1.0% by weight of Cu, 0.05 to 1.0% by weight of Cr, 0.0003 to 0.002% by weight of B, 0.0005 to 0.005% by weight of Ca and 0.001 to 0.02% by weight of REM, with the balance being Fe and unavoidable impurities, at a temperature of from 1100° to 1300° C. and hot rolling with a finishing temperature of from 800° to 1000° C. and naturally cooling to room temperature.

3. A process for manufacturing a building construction steel material having an excellent fire resistance and a low yield ratio, which comprises heating a slab, billet or bloom consisting of 0.04 to 0.15% by weight of C, up to 0.6% by weight of Si, 0.5 to 1.6% by weight of Mn, 0.2 to 0.7% by weight of Mo, up to 0.1% by weight of Al and up to 0.006% by weight of N, with the balance being Fe and unavoidable impurities, at a temperature of from 1100° to 1300° C., hot rolling with a finishing temperature of from 800° to 1000° C., air-cooling the rolled steel to a temperature of from $Ar_3$-20° C. to $Ar_3$-100° C., water-cooling the steel from said temperature to an arbitrary temperature lower than 550° C. at a cooling rate of 3° to 40° C./sec, and naturally cooling the steel.

4. A process for the manufacturing a building construction steel having an excellent fire resistance and a low yield ratio, which comprises heating a slab, billet, or bloom comprising of 0.04 to 0.15% by weight of C, up to 0.6% by weight of Si, 0.5 to 1.6% by weight of Mn, 0.2 to 0.7% by weight of Mo, up to 0.1% by weight of Al, up to 0.006% by weight of N and at least one member selected from the group consisting of 0.005 to 0.04% by weight of Nb, 0.005 to 0.10% by weight of Ti, 0.005 to 0.03% by weight of Zr, 0.005 to 0.10% by weight of V, 0.05 to 0.5% by weight of Ni, 0.05 to 1.0% by weight of Cu, 0.05 to 1.0% by weight of Cr, 0.0003 to 0.002% by weight of B, 0.0005 to 0.005% by weight of Ca and 0.001 to 0.02% by weight of REM, with the balance being Fe and unavoidable impurities, at a temperature of from 1100° to 1300° C., hot rolling with a finishing temperature of from 800° to 1000° C., air-cooling the rolled steel to a temperature of from $Ar_3$-20° C. to $Ar_3$-100° C., water-cooling the steel sheet from said temperature to an arbitrary temperature lower than 550° C. at a cooling rate of 3° to 40° C./sec, and naturally cooling the steel.

5. A manufacturing process according to claims 1 wherein the rolled steel is further subjected to a hot deforming process.

6. A manufacturing process according to claim 2, wherein the rolled steel is further subjected to a hot deforming process.

7. A manufacturing process according to claim 3, wherein the rolled steel is further subjected to a hot deforming process.

8. A manufacturing process according to claim 4, wherein the rolled steel is further subjected to a hot deforming process.

9. A manufacturing process according to claim 1, wherein the rolled steel is subjected to a cold deforming process.

10. A manufacturing process according to claim 2, wherein the rolled steel is subjected to a cold deforming process.

11. A manufacturing process according to claim 3, wherein the rolled steel is subjected to a cold deforming process.

12. A manufacturing process according to claim 4, wherein the rolled steel is subjected to a cold deforming process.

* * * * *

UNITED STATES PATENT AND TRADEMARK OFFICE

CERTIFICATE OF CORRECTION

PATENT NO. : 4,990,196

DATED : February 5, 1991

INVENTOR(S) : H. TAMEHIRO et al.

It is certified that error appears in the above-identified patent and that said Letters Patent is hereby corrected as shown below:

In Col. 17 at the bottom of Table 6 change "1/6 Mn" to -- C + 1/6 Mn --.

In Col. 17 at the bottom of Table 7 change "1/6 Mn" to -- C + 1/6 Mn --.

In Col. 17, Table 8 for steel 29 under Cu delete "0.45" and insert -- 0.25 --.

In Col. 17, Table 8, for steel 29 under Cr delete " - " and insert -- 0.45 --.

In Col. 19 at the bottom of Table 8 change "1/6 Mn" to -- C + 1/6 Mn --.

UNITED STATES PATENT AND TRADEMARK OFFICE

CERTIFICATE OF CORRECTION

PATENT NO. : 4,990,196

DATED : February 5, 1991

INVENTOR(S) : H. TAMEHIRO et al.

It is certified that error appears in the above-identified patent and that said Letters Patent is hereby corrected as shown below:

In Col. 19 at the bottom of Table 9 change "1/6 Mn" to -- C + 1/6 Mn --.

In Col. 24, Table 12, last column, steel 32, delete "75" and insert -- 73 --.

Signed and Sealed this

Twenty-second Day of December, 1992

*Attest:*

DOUGLAS B. COMER

*Attesting Officer*

*Acting Commissioner of Patents and Trademarks*